US011505932B2

(12) United States Patent
Kashimura et al.

(10) Patent No.: US 11,505,932 B2
(45) Date of Patent: Nov. 22, 2022

(54) WATER SUPPLY MECHANISM AND FLUSH TOILET

(71) Applicant: TOTO LTD., Kitakyushu (JP)

(72) Inventors: Hideaki Kashimura, Fukuoka (JP); Hiroki Tanaka, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/353,859

(22) Filed: Jun. 22, 2021

(65) Prior Publication Data

US 2021/0404161 A1 Dec. 30, 2021

(30) Foreign Application Priority Data

Jun. 30, 2020 (JP) ..... JP2020-113326

(51) Int. Cl.
*E03D 5/012* (2006.01)
*E03D 1/38* (2006.01)
*E03D 5/10* (2006.01)

(52) U.S. Cl.
CPC ..... *E03D 5/012* (2013.01); *E03D 1/38* (2013.01); *E03D 5/10* (2013.01); *E03D 2201/30* (2013.01)

(58) Field of Classification Search
CPC .. E03D 5/012; E03D 5/10; E03D 1/38; E03D 11/10; E03D 2201/30
USPC ..... 4/313, 324, 435, 438, 440–441
See application file for complete search history.

(56) References Cited

FOREIGN PATENT DOCUMENTS

| | | | | |
|---|---|---|---|---|
| JP | 2017-179784 | | 10/2017 | |
| JP | 2017179785 A | * | 10/2017 | |
| JP | 2018-096124 | | 6/2018 | |
| TW | 201713830 A | * | 4/2017 | ..... E03D 11/10 |

* cited by examiner

*Primary Examiner* — Tuan N Nguyen
(74) *Attorney, Agent, or Firm* — Amin, Turocy & Watson, LLP

(57) ABSTRACT

A water supply mechanism includes a switching part that executes switching between water supply and water shut-off, a manual operation valve on the switching part that is capable of a manual operation thereof, and a pushing member that pushes the manual operation valve to provide a valve-closed state. The manual operation valve is pulled in a direction opposite to a pushing direction of the pushing member to provide a valve-opened state. The manual operation valve includes a plunger, an external cylinder member that encloses the plunger, a first engaging point in the external cylinder member, and a fixation part in the external cylinder member that fixes the plunger in the valve-closed state or the valve-opened state. The plunger moves beyond the first engaging point as the manual operation valve is pulled, and is fixed in the valve-opened state as a pull of the manual operation valve is released.

9 Claims, 16 Drawing Sheets

WATER SUPPLY MECHANISM AND FLUSH TOILET

CROSS-REFERENCE TO RELATED APPLICATION(S)

The present application claims the benefit of priority to Japanese Patent Application No. 2020-113326 filed on Jun. 30, 2020, the entire contents of which Japanese Patent Application are incorporated by reference in the present application.

FIELD

A disclosed embodiment(s) relate(s) to a water supply mechanism and a flush toilet.

BACKGROUND

For a flush toilet that has a washing mechanism that utilizes a pump and/or an electromagnetic valve, toilet washing has conventionally been known that is executed by manually operating each of an operation part for closing a water drainage socket so as to store washing water with an amount that is needed for a siphon phenomenon in a bowl part of a toilet and an operation part for supplying washing water to the bowl part in such a manner that it is possible for a user to readily execute toilet washing at a time of power failure without executing work such as bucketing water.

In such a case, for example, a structure is provided where such two operation parts are configured to be operated by wires respectively and two wires are continued to be pulled simultaneously so as not to operate the two operation parts separately (see, for example, Japanese Patent Application Publication No. 2017-179784).

Furthermore, for example, a structure is provided where a water supply state is maintained by rotating a lever and such a water supply state is ended by pulling a wire for closing a water drainage socket and rotating the lever in an opposite direction (see, for example, Japanese Patent Application Publication No. 2018-096124).

However, among conventional techniques as described above, in a case of a structure where two wires are continued to be pulled simultaneously, the two wires have to be continued to be pulled constantly during an operation for toilet washing where a load on a user is increased.

Furthermore, in a case of a structure where a water supply state is maintained and ended by rotating a lever, a rotation operation of the lever and a pull operation of a wire have to be executed, so that, also in such a case, such an operation is complicated where a load on a user is increased. Additionally, in a case of such a structure, three steps with different operation directions, such as a step of rotating a lever, a step of pulling a wire, and a step of rotating the lever in an opposite direction, are provided, so that a load on a user is further increased.

SUMMARY

A water supply mechanism according to an aspect of an embodiment includes an electromagnetic valve and a switching part that each execute switching between water supply and water shut-off for a bowl part, a manual operation valve that is provided on the switching part and is capable of a manual operation thereof through a manual operation part, a transmission part that joins the manual operation valve and the manual operation part and transmits an operation of the manual operation part to the manual operation valve, and a pushing member that pushes the manual operation valve to provide a valve-closed state thereof, wherein the manual operation valve is pulled in a direction opposite to a pushing direction of the pushing member to provide a valve-opened state thereof, the manual operation valve has a plunger, an external cylinder member with a cylindrical shape that encloses the plunger, a first engaging point that is enclosed in the external cylinder member, and a fixation part that is enclosed in the external cylinder member and fixes the plunger in the valve-closed state or the valve-opened state, the plunger is joined to the transmission part, moves beyond the first engaging point relative to the external cylinder member as the manual operation valve is pulled by the manual operation part, and is fixed in the valve-opened state by the fixation part in a middle of returning thereof that is caused by being pushed by the pushing member as a pull of the pulled manual operation valve is released.

BRIEF DESCRIPTION OF DRAWING(S)

FIG. 10A is a timing chart that illustrates an example of an opening/closing timing of an opening/closing valve at a time of power failure and the like.

FIG. 10B is a timing chart that illustrates another example of an opening/closing timing of an opening/closing valve at a time of power failure and the like.

DESCRIPTION OF EMBODIMENT(S)

Hereinafter, an embodiment(s) of a water supply mechanism and a flush toilet as disclosed in the present application will be explained in detail with reference to the accompanying drawing(s). Additionally, this invention is not limited by an embodiment(s) as illustrated below.

1. First Embodiment

1-1. Configuration of Flush Toilet

Figure 1:
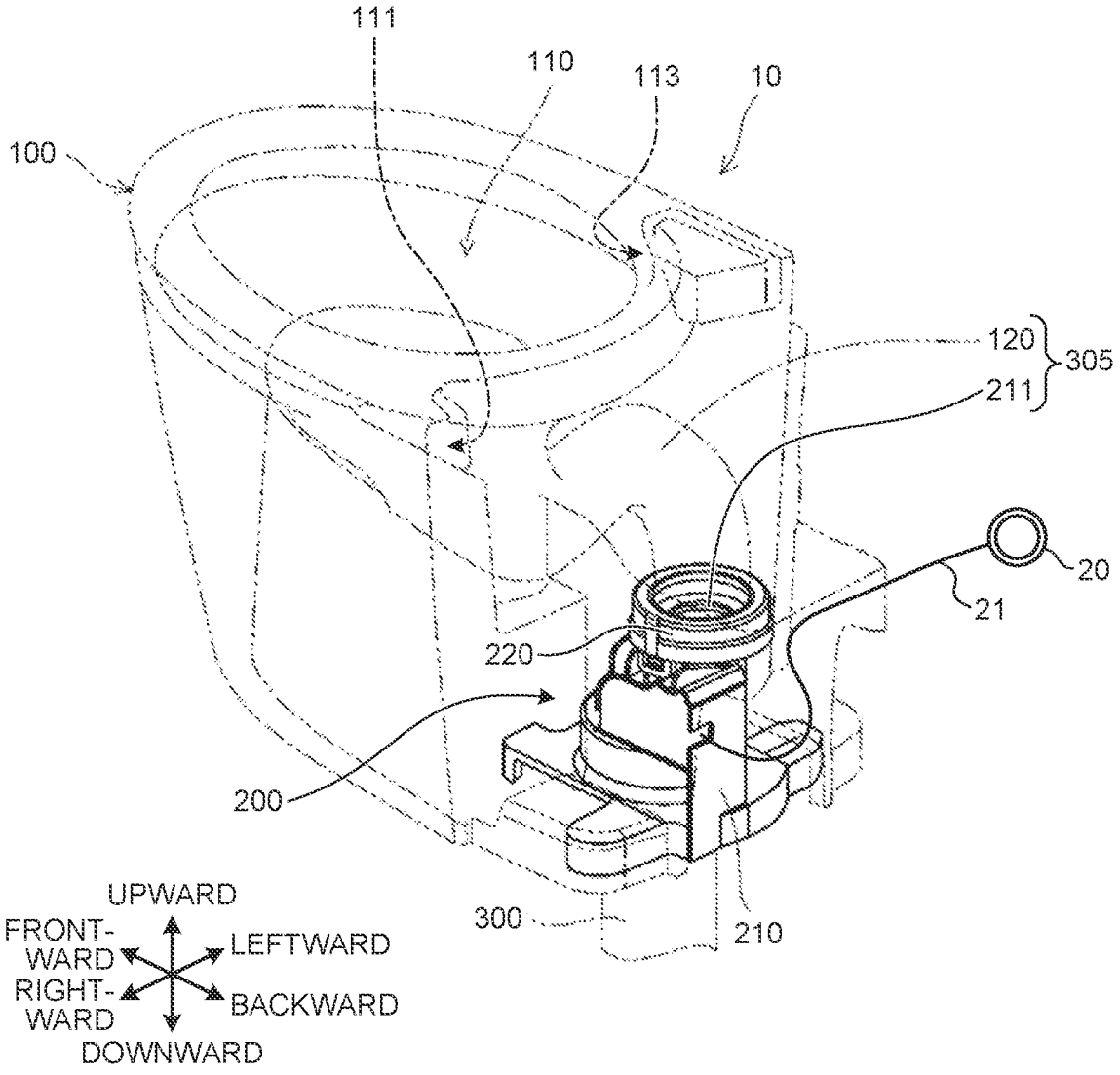
FIG. 1 is a schematic perspective view where a flush toilet according to a first embodiment is viewed obliquely backward.

FIG. 1 is a schematic perspective view where a flush toilet according to a first embodiment is viewed obliquely backward. As illustrated in FIG. 1, a flush toilet 10 includes a toilet body 100, a water drainage socket 200, and an operation part (a manual operation part) 20.

In the specification of the present application, a front side that is viewed by a user that stands in front of the toilet body 100 is provided as "frontward" and a back side is provided as "backward". Furthermore, a right side that is viewed by a user that stands in front of the toilet body 100 is provided as "rightward" and a left side is provided as "leftward". Furthermore, an upper side that is viewed by a user that stands in front of the toilet body 100 is provided as "upward" and a lower side is provided as "downward".

The toilet body 100 includes a bowl part 110 that receives waste, and a drainage water trap pipe line 120 that is connected to the bowl part 110 and guides waste in the bowl part 110 to a water drainage pipe 300.

A jet water spout port 111 that spouts washing water toward the drainage water trap pipe line 120 and a rim water spout port 113 that spouts washing water from a rim on an upper part of the bowl part 110 so as to form a swirling flow of washing water in the bowl part 110 are formed on the bowl part 110.

The drainage water trap pipe line 120 has a rising path part that extends upward from an inlet thereof, and a falling path part that extends downward from a terminal of the rising path part and is connected to the water drainage socket 200. Additionally, washing water (pooled water) for forming a water seal state is stored in the bowl part 110 to a rising path part of the drainage water trap pipe line 120.

The water drainage socket 200 includes a connection flow path 211 and is provided between the drainage water trap pipe line 120 and the water drainage pipe 300. Then, the water drainage socket 200 connects the drainage water trap pipe line 120 and the water drainage pipe 300 through the connection flow path 211.

Thus, in the flush toilet 10 according to the present embodiment, a water drainage path 305 that connects the bowl part 110 and the water drainage pipe 300 is formed by the drainage water trap pipe line 120 and the connection flow path 211. The flush toilet 10 is a so-called hybrid type that executes a rim water spout from the rim water spout port 113 at a direct pressure of a water supply and executes water drainage by opening/closing of the water drainage socket 200.

The toilet body 100 that is configured as described above efficiently causes a siphon action by washing water that is spouted from the jet water spout port 111, and draws waste in the bowl part 110 into the water drainage path 305 by utilizing the siphon action as described above so as to drain it to the water drainage pipe 300.

1-2. Configuration of Water Drainage Socket

Figure 2A:
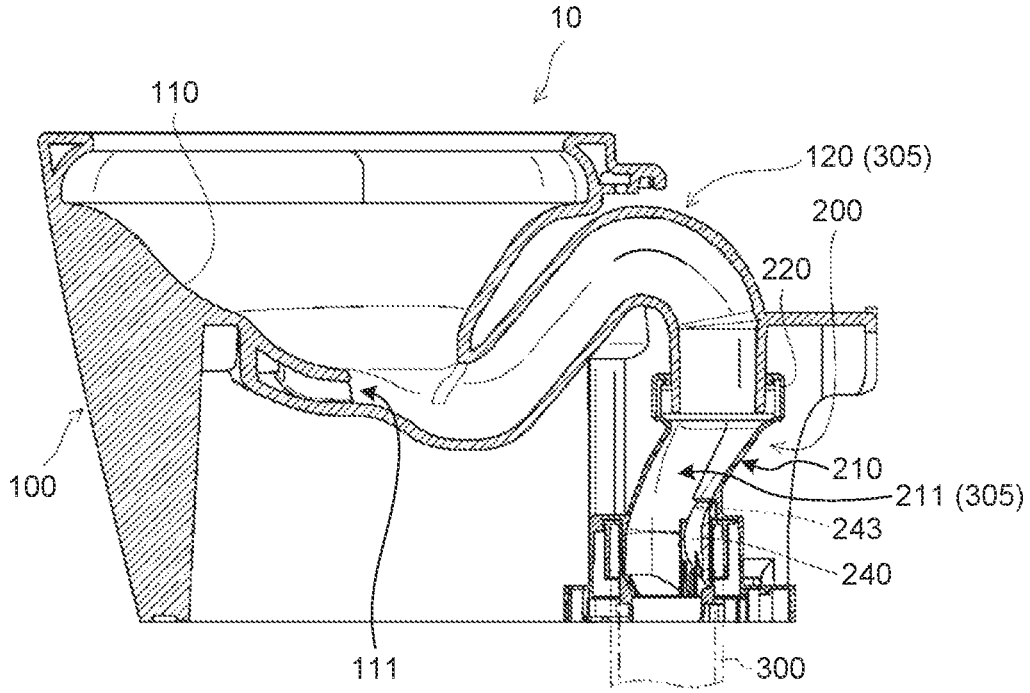
FIG. 2A is a schematic cross-sectional view (part 1) that illustrates an internal configuration of a water drainage socket.
Figure 2B:
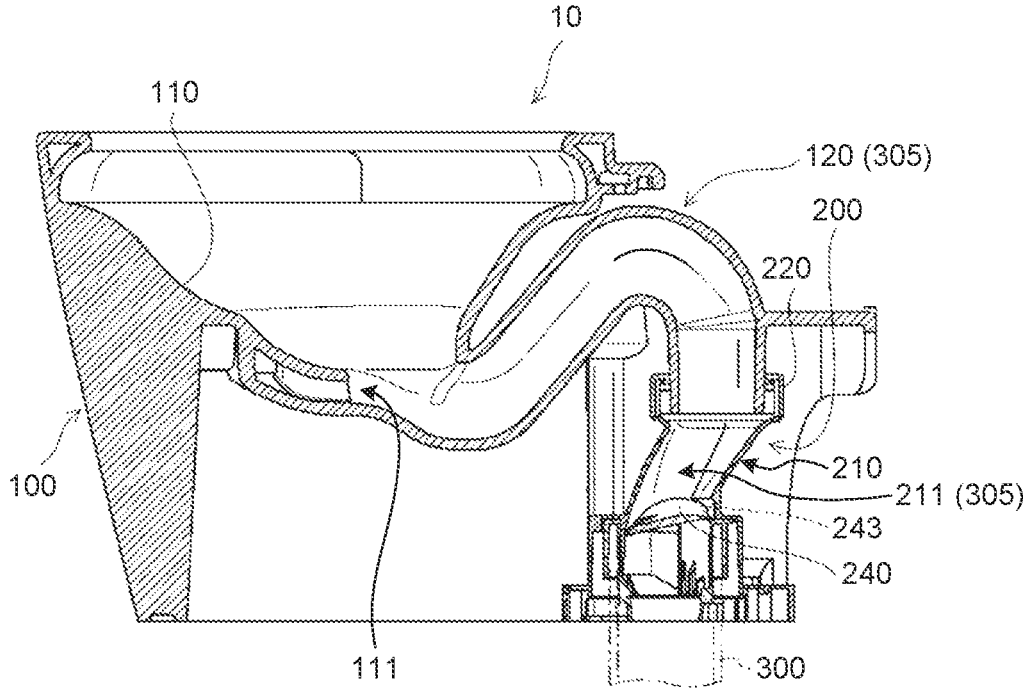
FIG. 2B is a schematic cross-sectional view (part 2) that illustrates an internal configuration of a water drainage socket.

Next, a configuration of a water drainage socket 200 will be specifically explained with further reference to FIG. 2A and FIG. 2B. FIG. 2A and FIG. 2B are schematic cross-sectional views that illustrate an internal configuration of the water drainage socket 200. Additionally, FIG. 2A and FIG. 2B illustrate a state where an opening/closing valve 240 is opened and a state where the opening/closing valve 240 is closed, respectively.

As illustrated in FIG. 1, the water drainage socket 200 is a floor-drain-type water drainage socket and includes a socket body 210 and a packing 220. The packing 220 is provided on an upper end part of the socket body 210 and is formed of, for example, a material that has elasticity such as a rubber. The packing 220 has a through-hole that penetrates in upward and downward directions and an end part of a drainage water trap pipe line 120 on a downstream side thereof is connected to such a through-hole.

As illustrated in FIG. 2A and FIG. 2B, the socket body 210 includes a connection flow path 211 as described above and connects the drainage water trap pipe line 120 and a water drainage pipe 300.

Furthermore, the water drainage socket 200 includes an opening/closing valve 240 and a rotating shaft 243. The opening/closing valve 240 is provided on the connection flow path 211 that is a part of a water drainage path 305 and opens or closes the water drainage path 305 (exactly, the connection flow path 211). Additionally, for the opening/closing valve 240, it is possible to use, for example, a flapper valve where this is not limiting.

The rotating shaft 243 supports the opening/closing valve 240 so as to be rotatable. A manual operation part 20 (see FIG. 1) is connected to such a rotating shaft 243 through a transmission part 21 as described later.

As illustrated in FIG. 1, the manual operation part (that will be referred to as a first operation part below) 20 is connected to the rotating shaft 243 of the opening/closing valve 240 through a first wire 21 that is a transmission part that transmits a manual operation that is executed by a user thereto. The first operation part 20 is, for example, a member with a ring shape that receives a manual operation of a user when toilet washing is executed at a time of power failure. Additionally, such a member is an example of a member that receives a manual operation.

For the first wire 21, it is possible to use, for example, a release wire. Specifically, the first wire 21 includes an outer tube and an inner wire that is inserted into and provided in an inside of the outer tube although illustration thereof is not provided.

While one end of an inner wire of the first wire 21 is connected to the rotating shaft 243 of the opening/closing valve 240 as described above, another end thereof is connected to the first operation part 20.

For example, as a user manually executes an operation (a pull operation) for the first operation part 20, such as pulling the first operation part 20, an inner wire of the first wire 21 is moved so as to rotate the rotating shaft 243 and thereby rotate the opening/closing valve 240.

In such a case, the opening/closing valve 240 is maintained in an opened state as illustrated in FIG. 2A, at a normal time when the first operation part 20 is not operated by a user. Therefore, the opening/closing valve 240 does not change a flow path cross-sectional area of the connection flow path 211 at a normal time.

On the other hand, as a user executes a pull operation of the first operation part 20, the opening/closing valve 240 is rotated around the rotating shaft 243 as a center thereof in association with movement of an inner wire so as to provide a closed state as illustrated in FIG. 2B, that is, a state where a flow path cross-sectional area of the connection flow path 211 is decreased.

Additionally, the opening/closing valve 240 does not have to close the connection flow path 211 completely. That is, it is sufficient that it is possible to raise a water level inside a bowl part 110 from an initial water level by washing water that is supplied from a rim water spout port 113 and a jet water spout port 111, where a certain amount of a gap may be present between the opening/closing valve 240 and the connection flow path 211.

Although an example where the water drainage socket 200 includes the opening/closing valve 240 as a configuration to change a flow path cross-sectional area of the connection flow path 211 has been explained herein, the water drainage socket 200 may include, for example, a turn trap instead of the opening/closing valve 240. A turn trap is electrically driven so as to rotate upward or downward, so that it is possible to drain washing water that is stored in the bowl part 110 together with sewage. Furthermore, although an example where the opening/closing valve 240 is provided on the connection flow path 211 has been explained herein, a movable part such as the opening/closing valve 240 and/or a turn trap may be provided on the drainage water trap pipe line 120.

Additionally, the first operation part 20 is arranged inside a non-illustrated decorative panel that is provided behind a toilet body 100 and is provided in a state where it is not visible from outside. It is possible for a user to execute a manual operation of the first operation part 20 by removing a decorative panel.

1-3. Configuration of Toilet Washing Device

Figure 3:
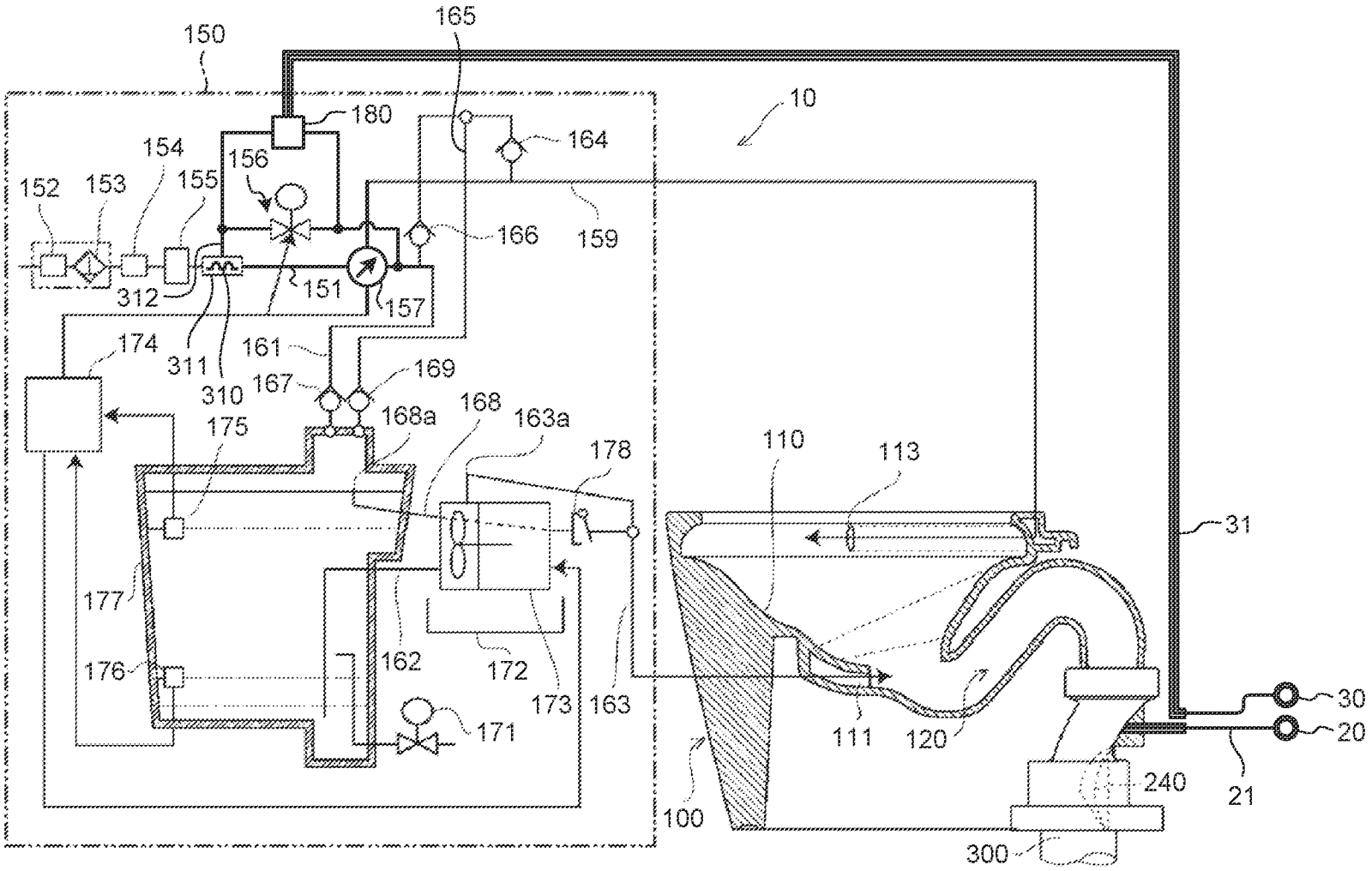
FIG. 3 is a diagram that illustrates a configuration of a toilet washing device.

Next, a configuration of a toilet washing device that executes toilet washing in a flush toilet 10 will be explained with reference to FIG. 3. FIG. 3 is a diagram that illustrates a configuration of a toilet washing device.

As illustrated in FIG. 3, a toilet washing device 150 is arranged near a back of a toilet body 100. The toilet washing device 150 is connected to a non-illustrated external power source, so that a component such as an electromagnetic valve is driven by using external power that is supplied from the external power source at a time of no power failure so as to supply washing water to a bowl part 110.

The toilet washing device 150 includes a constant flow valve 155, an electromagnetic valve 156, and a vacuum breaker for a rim water spout 164. A switching valve 157 that switches between water supply to a storage tank 177 and rim water spout, the storage tank 177, a pressurization pump 173, a vacuum breaker for a jet water spout 166, and a water drain tap 171 are incorporated in a water supply path 151. Furthermore, a control part 174 that controls an opening/closing operation of the electromagnetic valve 156, a switching operation of the switching valve 157, a pressurization operation of the pressurization pump 173, and the like is incorporated in the toilet washing device 150.

The constant flow valve 155 reduces washing water that flows therein through a water stop cock 152, a strainer 153, and a branching bracket 154 so as to provide a predetermined flow rate or less. For example, the constant flow valve 155 regulates a flow rate of washing water so as to be 16 liters/minute or less. Washing water that passes through the constant flow valve 155 flows into the electromagnetic valve 156 and washing water that passes through the electromagnetic valve 156 is supplied to a rim water spout port 113 or the storage tank 177 by the switching valve 157.

The electromagnetic valve 156 is a diaphragm-type electromagnetic opening/closing valve that is opened or closed according to control of the control part 174. A diaphragm 310 is provided on the water supply path 151 and a pressure chamber 311 is provided so as to be adjacent to such a diaphragm 310. Then, the electromagnetic valve 156 changes a pressure in the pressure chamber 311 so as to operate the diaphragm 310 and thereby control a flow of washing water on the water supply path 151.

Specifically, the electromagnetic valve 156 is provided in a valve-opened state as an opening signal is input thereto from the control part 174, and thereby, a pressure in the pressure chamber 311 is decreased, so that the diaphragm 310 opens the water supply path 151 so as to cause supplied washing water to flow into the switching valve 157. On the other hand, the electromagnetic valve 156 is provided in a valve-closed state as a closing signal is input thereto from the control part 174, and thereby, a pressure in the pressure chamber 311 is increased, so that the diaphragm 310 closes the water supply path 151 so as to stop supply of washing water to the switching valve 157. Additionally, a detailed configuration(s) of the electromagnetic valve 156 and/or the diaphragm 310 will be described later, by using FIG. 5.

The switching valve 157 is switched by a control signal of the control part 174 so as to spout washing water that flows therein through the electromagnetic valve 156, from the rim water spout port 113 or cause it to flow into the storage tank 177.

The vacuum breaker for a rim water spout 164 is arranged in a middle of a rim side water supply path 159 that guides washing water that passes through the switching valve 157 to the rim water spout port 113 so as to prevent a backward flow of washing water from the rim water spout port 113. Furthermore, the vacuum breaker for a rim water spout 164 is arranged above an upper end surface of the bowl part 110 and thereby prevents a backward flow reliably. Moreover, washing water that overflows an atmospheric relief part of the vacuum breaker for a rim water spout 164 passes through a return pipe line 165 and flows into the storage tank 177 through a float-type check valve 169.

The storage tank 177 stores washing water that should be spouted from a jet water spout port 111. For example, the storage tank 177 has an inner volume of about 2.5 liters.

Moreover, in the present embodiment, a tip (a lower end) of a tank side water supply path 161 is connected to a float-type check valve 167 so as to prevent a backward flow from the storage tank 177 to the tank side water supply path 161. Furthermore, an upper end float switch 175 and a lower end float switch 176 are arranged inside the storage tank 177, so that it is possible to detect a water level in the storage tank 177. The upper end float switch 175 is switched on as a water level in the storage tank 177 reaches a predetermined water level of stored water therein, and the control part 174 detects it so as to close the electromagnetic valve 156. On the other hand, the lower end float switch 176 is switched on as a water level in the storage tank 177 is lowered to a predetermined water level, and the control part 174 detects it so as to stop the pressurization pump 173.

The pressurization pump 173 pressurizes washing water that is stored in the storage tank 177 so as to spout it from the jet water spout port 111. The pressurization pump 173 is connected thereto by a pump side water supply path 162 that extends from the storage tank 177 so as to pressurize washing water that is stored in the storage tank 177. For example, the pressurization pump 173 pressurizes washing water in the storage tank 177 so as to spout washing water from the jet water spout port 111 at a maximum flow rate of about 120 liters/minute.

The water drain tap 171 is arranged at a position near a lower end part of the storage tank 177 and below the pressurization pump 173. Hence, the water drain tap 171 is opened, so that it is possible to drain washing water in the storage tank 177 and the pressurization pump 173 at a time of maintenance or the like. Furthermore, a water-receiving tray 172 is arranged below the pressurization pump 173. The water-receiving tray 172 receives a dew-condensed water droplet(s) and/or leaked water.

On the other hand, an outflow port of the pressurization pump 173 is connected to the jet water spout port 111 on a bottom part of the bowl part 110 through a jet side water supply path 163. A middle of the jet side water supply path 163 is formed into an upwardly convex shape where a jet side water supply path top part 163*a* that is a highest part of such a convex type part is a highest part on a washing water pipe line from the storage tank 177 to the jet water spout port 111. Furthermore, a downstream side of the jet side water supply path top part 163*a* of the jet side water supply path 163 is set at a height that is identical to that of the jet water spout port 111 as described previously.

An overflow flow path 168 that has an overflow port 168*a* on an end thereof is connected to the jet side water supply path 163. The overflow port 168*a* is provided above an upper end float switch 175. In a case where a water level in the storage tank 177 is higher than the upper end float switch 175, water in the storage tank 177 flows from the overflow port 168*a* into the overflow flow path 168, is pressurized by the pressurization pump 173, and is spouted from the jet water spout port 111 through a flapper valve 178.

The vacuum breaker for a jet water spout 166 is arranged on a middle of the tank side water supply path 161 that guides washing water that passes through the switching valve 157 to the storage tank 177 so as to prevent a backward flow of washing water from the storage tank 177. Washing water that overflows an atmospheric relief part of the vacuum breaker for a jet water spout 166 is provided so as to pass through the return pipe line 165 and flow into the storage tank 177 through the float-type check valve 169.

The control part 174 sequentially activates the electromagnetic valve 156, the switching valve 157, and the pressurization pump 173, according to an operation of a (non-illustrated) toilet washing switch that is executed by a user, so that water spouts from the rim water spout port 113 and the jet water spout port 111 are started sequentially so as to wash the bowl part 110. Moreover, after an end of washing, the control part 174 opens the electromagnetic valve 156 and switches the switching valve 157 to a side of the storage tank 177 so as to resupply washing water to the storage tank 177. As a water level in the storage tank 177 is raised and a defined amount of stored water is detected by the upper end float switch 175, the control part 174 closes the electromagnetic valve 156 so as to stop water supply.

As illustrated in FIG. 3, a manual operation part (that will be referred to as a second operation part below) 30 is connected to a switching part 180 as described later through a second wire 31 that is a transmission part. The second operation part 30 is, for example, a member with a ring shape that receives a manual operation of a user when toilet washing is executed at a time of power failure, similarly to a first operation part 20 as described above. Additionally, such a member is an example of a member that receives a manual operation.

Furthermore, for the second wire 31, it is possible to use, for example, a release wire, similarly to the first wire 21 as described above. Also in such a case, the second wire 31 includes an outer tube and an inner wire that is inserted into and provided in an inside of the outer tube, similarly to the first wire 21. The second wire 31 joins a manual operation valve 181 (see FIG. 6) as described later and the second operation part 30 so as to transmit an operation of the second operation part 30 to the manual operation valve 181.

1-4. Toilet Washing Operation at Time of No Power Failure

Herein, a toilet washing operation at a time of no power failure, that is, in a case where an electromagnetic valve 156 is operated by an external power source will be explained.

For example, as a non-illustrated toilet washing switch is operated at a time of no power failure, a first rim water spout (front rim washing) is started. Specifically, a control part 174 inputs an opening signal to the electromagnetic valve 156 so as to open the electromagnetic valve 156 and switches a switching valve 157 to a side of a rim water spout port 113. Thereby, washing water is spouted from the rim water spout port 113 by a water supply pressure of a water supply. Washing water that is spouted from the rim water spout port 113 swirls in a bowl part 110 and flows downward, so that an inner wall surface of the bowl part 110 is washed.

Although a jet water spout is started subsequently, a water spout of washing water from the rim water spout port 113 is also continued in such a period. First, the control part 174 sends a signal to a pressurization pump 173 so as to activate the pressurization pump 173. As the pressurization pump 173 is activated, washing water that is stored in a storage tank 177 flows into and is pressurized by the pressurization pump 173. Washing water that is pressurized by the pressurization pump 173 passes through a jet side water supply path top part 163*a* of a jet side water supply path 163 and is spouted from a jet water spout port 111 that is opened on a bottom part of the bowl part 110.

Washing water that is spouted from the jet water spout port 111 flows into a drainage water trap pipe line 120 so as to fill the drainage water trap pipe line 120 with such water and cause a siphon action. By such a siphon action, pooled water and waste in the bowl part 110 are suctioned into the drainage water trap pipe line 120 and are drained from a water drainage pipe 300.

As washing water is spouted from the jet water spout port 111 by the pressurization pump 173, a water level in the storage tank 177 is lowered, so that a lower end float switch 176 is turned on. As the lower end float switch 176 is turned on, the control part 174 detects that washing water that is stored in the storage tank 177 is absent, sends a signal to the pressurization pump 173 so as to stop it, and ends a jet water spout. A water level of pooled water in the bowl part 110 is raised by a water spout from the rim water spout port 113 that is executed continuously, and after a predetermined period of time for a rim water spout has passed, a predetermined water level of pooled water in the bowl part 110 is reached (refill).

After an end of a rim water spout, the control part 174 sends a signal to the switching valve 157 in a state where the electromagnetic valve 156 is held in an opened state thereof, so that the switching valve 157 is switched to a side of the storage tank 177. Thereby, washing water flows into the storage tank 177 so as to resupply the washing water to the storage tank 177.

As washing water is resupplied into the storage tank 177 so that a water level in the storage tank 177 reaches a defined water level of stored water, an upper end float switch 175 is turned on. As the upper end float switch 175 is turned on, the control part 174 sends a closing signal to the electromagnetic valve 156 so as to close the electromagnetic valve 156. Furthermore, the control part 174 sends a signal to the switching valve 157 so as to switch it to a side of the rim water spout port 113. Then, a flush toilet 10 is provided in a standby state thereof.

Thus, the flush toilet 10 according to the present embodiment uses power that is supplied from an external power source and controls operations of the electromagnetic valve 156, the switching valve 157, the pressurization pump 173, and the like, by signals from the control part 174, so as to execute toilet washing.

Meanwhile, although it is possible for a toilet washing device 150 to operate the electromagnetic valve 156 or the like by using external electric power from an external power source at a time of no power failure so as to execute toilet washing as described above, it is not possible to operate the electromagnetic valve 156 or the like at a time of power failure. Additionally, for example, in a case where a capacitor is incorporated as an emergency power source, a cost increase is caused, or in a case where a configuration is provided in such a manner that a battery or the like is used without incorporating a capacitor therein, a user has to add such a battery where a load on a user is increased.

Furthermore, also in a case where a configuration is provided so as not to execute electrical water supply, for example, water supply and water shut-off are executed by operations of two operation parts, an operation is complicated, for example, in such a manner that the two operation parts have to be separately operated by respectively different operations, the two operation parts (two wires) have to be continued to be pulled simultaneously, or the like. Furthermore, two wires are pulled simultaneously, so that, as a pull thereof is stopped, a water drainage socket 200 is provided in an opened state so as to end water supply, and hence, for example, in a case where resupplied water (refill water) is insufficient, the two wires have to be pulled and adjusted again or water supply from an outside or the like has to be executed.

Furthermore, although a configuration may be provided, for example, in such a manner that water supply and water shut-off are executed by rotation of a lever and opening/closing of a water drainage socket is executed by a pull of a wire, an operation in such a case is also complicated. Additionally, in order to transmit a rotational force of a lever to a water supply mechanism, the lever has to be placed near the water supply mechanism, so that a degree of freedom of a design is also decreased.

Thus, a load on a user for a washing operation at a time of power failure has ever been large. Hence, in the present embodiment, a configuration is provided in such a manner that it is possible for a user to execute water supply and water shut-off by a simple operation so that it is possible to reduce a load of toilet washing on a user at a time of power failure.

1-5. Configuration of Flush Toilet for Executing Toilet Washing at a Time of Power Failure Hereinafter, a configuration for executing toilet washing at a time of power failure in a flush toilet 10 will further be explained. As illustrated in FIG. 3 and as described above, a switching part 180 is provided on a flow path 312 that is connected to a pressure chamber 311 as described above. Additionally, such a flow path 312 is a flow path that causes water in the pressure chamber 311 to flow out so as to release a pressure in the pressure chamber 311, and may be described as a "pilot flow path".

Furthermore, as described above, a second operation part 30 is connected to the switching part 180. A second wire 31 of the second operation part 30 is connected to the switching part 180. Thus, a first wire 21 that is connected to a first operation part 20 is connected to an opening/closing valve 240 and the second wire 31 that is connected to the second operation part 30 is connected to the switching part 180. That is, a configuration is provided in such a manner that the first operation part 20 and the second operation part 30 are manually pulled and operated by a user so that it is possible to operate the opening/closing valve 240 and the switching part 180.

Additionally, it is preferable to provide the first wire 21 and the second wire 31 in parallel, at least, on a hand of a user. Thereby, it is possible to improve operability of each of the first wire 21 and the second wire 31 and arrange and provide the first wire 21 and the second wire 31 in respective suitable layouts, so that it is possible to improve workability.

Figure 4:
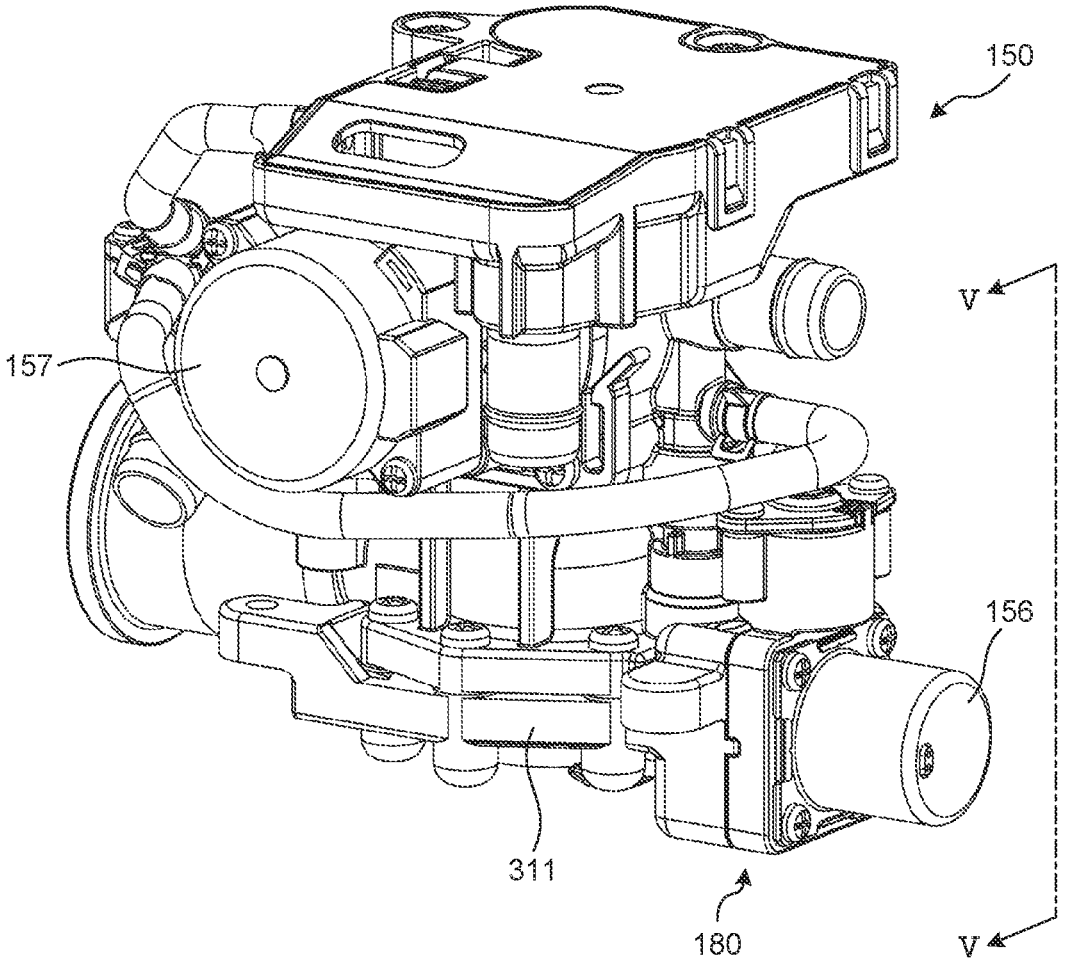
FIG. 4 is a schematic perspective view that illustrates a toilet washing device according to a first embodiment.

FIG. 4 is a schematic perspective view that illustrates a toilet washing device 150 according to a first embodiment. Although an electromagnetic valve 156, a switching valve 157, a switching part 180, and/or the like as described above is/are configured integrally and united in the toilet washing device 150 as illustrated in FIG. 4, this is not limiting and a part or all of components may be configured separately.

Figure 5:
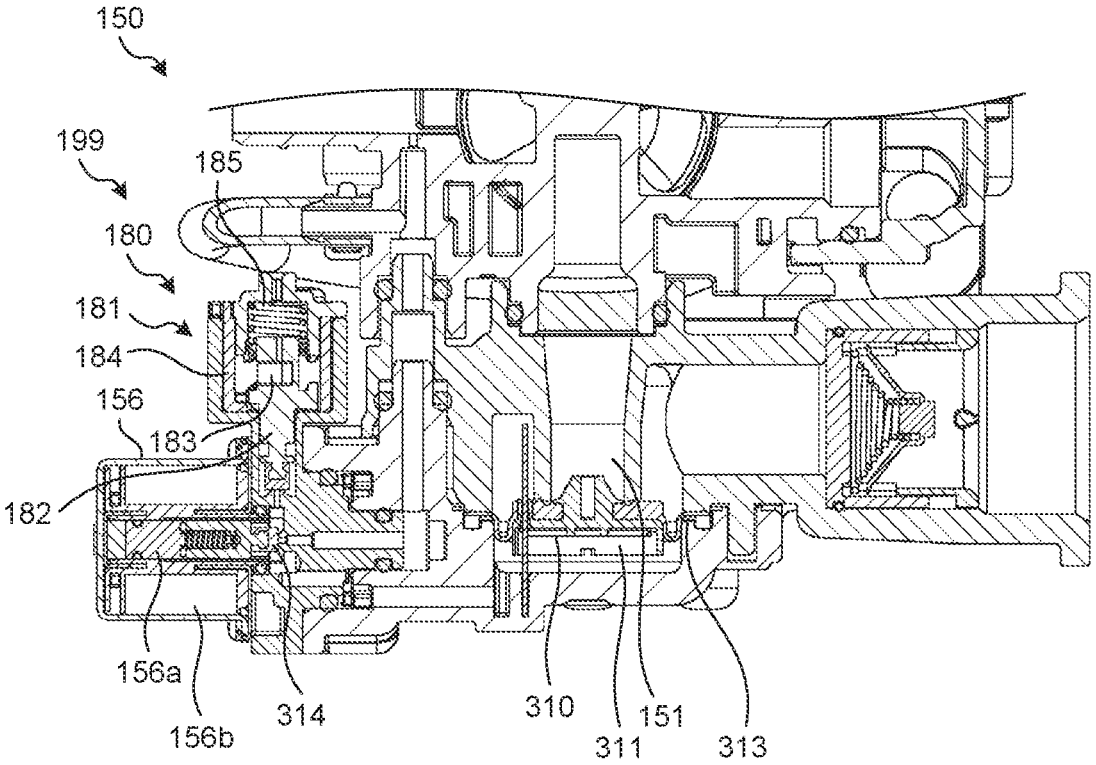
FIG. 5 is a cross-sectional view along line V-V in FIG. 4.

FIG. 5 is a cross-sectional view along line V-V in FIG. 4. That is, FIG. 5 is a schematic cross-sectional view near a water supply mechanism 199 in the toilet washing device 150.

Both the electromagnetic valve 156 and the switching part 180 open or close a water supply path 151 so as to execute switching between water supply and water shut-off for a bowl part 110. First, the electromagnetic valve 156 will be explained.

The electromagnetic valve 156 is a diaphragm-type electromagnetic opening/closing valve, so that the toilet washing device 150 includes a diaphragm 310, the pressure chamber 311, and the pilot flow path 312 (see FIG. 3). The electromagnetic valve 156 includes a valve body **156*a* and a solenoid 156*b***.

The diaphragm 310 is configured to be capable of being seated on a valve seat 313 that is provided on the water supply path 151 to the bowl part 110. Thereby, when the diaphragm 310 is provided in a state where it is seated on the valve seat 313, the water supply path 151 is closed by the diaphragm 310 so as to be partitioned into an upstream side water supply path and a downstream side water supply path. Additionally, in this specification, "upstream" and "downstream" are used as meanings of "upstream" and "downstream" in a direction of a flow of washing water.

The pressure chamber 311 is provided so as to be adjacent to a position on an opposite side of the water supply path 151 in the diaphragm 310. Furthermore, a hole that is communicated with the pressure chamber 311 and an upstream side water supply path is formed on the diaphragm 310. Thereby, water on an upstream side water supply path flows into the pressure chamber 311 through a hole. That is, the pressure chamber 311 is filled with water that flows therein from an upstream side water supply path.

While one end of the pilot flow path 312 is connected to the pressure chamber 311, another end thereof is connected to a tank side water supply path 161 (see FIG. 3) that leads to a storage tank 177 (see FIG. 3).

The electromagnetic valve 156 opens or closes the pilot flow path 312. The electromagnetic valve 156 closes the pilot flow path 312 when the valve body **156*a* is provided in a state where it is seated on the valve seat 313 that is provided on the pilot flow path 312**.

As the pilot flow path 312 is closed by the electromagnetic valve 156, a water pressure from an upstream side water supply path acts on the pressure chamber 311, that is, an internal pressure of the pressure chamber 311 is increased so as to move the diaphragm 310 toward the valve seat 313. Thereby, the diaphragm 310 is provided in a water shut-off state where it is seated on the valve seat 313 so as to close the water supply path 151.

Then, for example, as an opening signal is input from a control part 174 (see FIG. 3) to the electromagnetic valve 156, it conducts electricity through the solenoid 156*b* so as to lift the valve body 156*a*, separate it from the valve seat 313, and open the pilot flow path 312.

Thereby, water in the pressure chamber 311 flows out from the pressure chamber 311 to the pilot flow path 312. Additionally, water that flows out to the pilot flow path 312 passes through the valve body 156*a*, and subsequently flows out from an outlet part of the pilot flow path 312 to the storage tank 177 through the tank side water supply path 161.

Thus, as the pilot flow path 312 is opened by the electromagnetic valve 156, water in the pressure chamber 311 flows out, that is, an internal pressure of the pressure chamber 311 is decreased so that the diaphragm 310 is moved so as to be separated from the valve seat 313. Thereby, the diaphragm 310 is provided in a water supply state where the water supply path 151 is opened, and in such a case, communication between an upstream side water supply path and a downstream side water supply path is attained so that washing water flows into the switching valve 157.

Thus, the diaphragm 310 switches between a water shut-off state where the water supply path 151 is closed and a water supply state where the water supply path 151 is opened.

Next, the switching part 180 will be explained. The switching part 180 includes a manual operation valve 181 and a cam part. It is possible for a user to execute a manual operation of the manual operation valve 181 through the second operation part 30 (see FIG. 3). The manual operation valve 181 is, for example, a poppet valve. As the second wire 31 of the second operation part 30 is manually operated by a user, an operational force of a manual operation is transmitted to a shaft, so that the shaft is rotated around a predetermined axis of rotation.

A cam part is provided on an end part of a rotatable shaft as described above. Hence, a cam part is also rotated around a predetermined axis of rotation in association with rotation of a shaft that is caused by a manual operation of the second operation part 30.

The manual operation valve 181 is provided on the pilot flow path 312. The manual operation valve 181 includes a valve body 182, a plunger 183, an external cylinder member 184, and a pushing member 185. The switching part 180 that includes such a manual operation valve 181, and the electromagnetic valve 156, the second operation part 30, the second wire 31, or the like as described above compose the water supply mechanism 199 for washing water in the toilet washing device 150.

As illustrated in FIG. 5, a bypass path 314 that bypasses an upstream side and a downstream side of the valve body 156*a* of the electromagnetic valve 156 is formed on the pilot flow path 312. Then, the manual operation valve 181 opens or closes such a bypass path 314.

The plunger 183 is inserted through an insertion hole near a center of the valve body 182 and is fixed in an inserted state. The plunger 183 is a member with an elongated shape and is arranged in such a manner that a tip thereof penetrates the bypass path 314 and protrudes to a neighborhood of a cam part that is positioned on a downstream side of the electromagnetic valve 156 on the pilot flow path 312.

The external cylinder member 184 is a member with a cylindrical shape (preferably, a circularly cylindrical shape) and is fixed at an appropriate position near an inlet of the pilot flow path 312. Additionally, a flow path where water that flows out from the pressure chamber 311 is capable of flowing is formed on the external cylinder member 184.

The pushing member 185 is, for example, a coil spring and is arranged between the plunger 183 and the external cylinder member 184. The pushing member 185 presses the valve body 182 so as to close it. In other words, the pushing member 185 pushes the plunger 183 and/or the valve body 182 so as to provide a valve-closed state.

The switching part 180 that is configured as described above is operated according to a manual operation of a user for the second operation part 30 (see FIG. 3). Specifically, as the second operation part 30 is operated, a cam part is rotated, and by rotation of the cam part, the plunger 183 receives a force that is a pushing force of the pushing member 185 and a water pressure on the pilot flow path 312, so that the valve body 182 is opened so as to open the pilot flow path 312.

Thereby, water in the pressure chamber 311 flows out from the pressure chamber 311 to the pilot flow path 312 and water that flows out to the pilot flow path 312 flows into the bypass path 314. Water that flows into the bypass path 314 flows out to the storage tank 177 through a route that is similar to that of a case where the electromagnetic valve 156 is opened.

Thus, the manual operation valve 181 causes water in the pressure chamber 311 to flow out through the pilot flow path 312 similarly to a case where the electromagnetic valve 156 is opened. In other words, on the pilot flow path 312, a part of a route for water in a case where it is opened by the manual operation valve 181 and a part of a route for water in a case where it is opened by the electromagnetic valve 156 are identical so as to attain sharing of the pilot flow path 312.

In the present embodiment, sharing of the pilot flow path 312 as described above is attained, so that it is possible to downsize the toilet washing device 150 and eventually it is possible to downsize all of the flush toilet 10.

As described above, as the pilot flow path 312 is opened by the manual operation valve 181, water in the pressure chamber 311 flows out, so that an internal pressure of the pressure chamber 311 is decreased and the diaphragm 310 is moved so as to separate from the valve seat 313. Thereby, the diaphragm 310 is provided in a water supply state where the water supply path 151 is opened. Thus, in the flush toilet 10 according to the present embodiment, it is possible to execute switching between water supply and water shut-off for the bowl part 110 by a manual operation of a user.

1-6. Configuration of Switching Part

Figure 6:
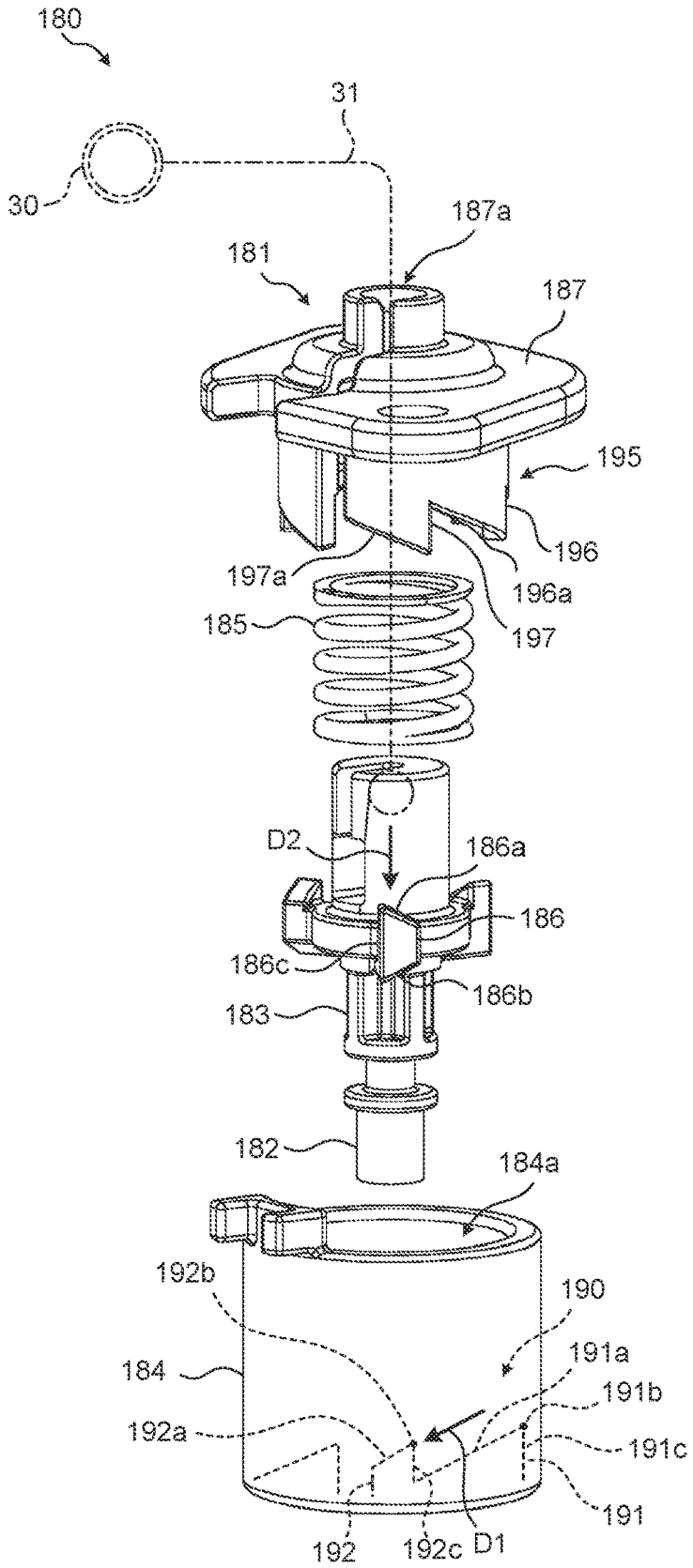
FIG. 6 is a schematic exploded perspective view that illustrates a switching part according to a first embodiment.

Next, a configuration of a switching part 180 will be explained with reference to FIG. 6. FIG. 6 is a schematic exploded perspective view that illustrates a switching part 180 according to a first embodiment. As described above, a water supply mechanism 199 includes an electromagnetic valve 156, a switching part 180 (a manual operation valve 181), a manual operation part (a second operation part) 30, and a transmission part (a second wire) 31.

Each of the electromagnetic valve 156 and the switching part 180 executes switching between water supply and water shut-off for a bowl part 110 (see FIG. 1). The switching part 180 includes the manual operation valve 181. The manual operation valve 181 is capable of executing a manual operation through the second operation part 30 and includes a valve body 182, a plunger 183, an external cylinder member 184, and a pushing member 185 as described above. In the water supply mechanism 199, the manual operation valve 181 is pulled by the second wire 31 in a direction opposite to a pushing direction of the pushing member 185 so as to be provided in a valve-opened state.

Furthermore, the manual operation valve 181 has a first engaging point 191*b* and a second engaging point 192*b*. Furthermore, the manual operation valve 181 has fixation parts 191*c*, 192*c*. Any of the first engaging point 191*b*, the second engaging point 192*b*, and the fixation parts 191*c*, 192*c* is enclosed in the external cylinder member 184. Additionally, details of the first engaging point 191*b*, the second engaging point 192*b*, and the fixation parts 191*c*, 192*c* will be described later.

The plunger 183 is formed substantially integrally with the valve body 182 that is arranged on a lower part thereof. The plunger 183 is enclosed in the external cylinder member 184. The plunger 183 has a cam part 186 that is provided on an outer peripheral surface thereof. The cam part 186 is formed into a block shape and has an upper part sloping surface 186*a* and a lower part sloping surface 186*b*. A plurality of (for example, three) cam parts 186 are provided at a predetermined interval(s) along a peripheral direction on an outer peripheral surface of the plunger 183.

The external cylinder member 184 has a guide rib 190 that is provided on an inner peripheral surface thereof. In other words, the guide rib 190 is enclosed in the external cylinder member 184. The guide rib 190 has a first sloping surface 191*a* and a second sloping surface 192*a* that are two sloping surfaces. As the manual operation valve 181 (the plunger 183) is pulled, the lower part sloping surface 186*b* of the cam part 186 of the plunger 183 is slid along one of the first sloping surface 191*a* and the second sloping surface 192*a*, so that the guide rib 190 guides the plunger 183 in a predetermined movement direction as indicated by an arrow D1 in the figure.

The guide rib 190 has a first protrusion part 191 and a second protrusion part 192. Each of the first protrusion part 191 and the second protrusion part 192 is formed on an upper part of the guide rib 190. The first protrusion part 191 has the first sloping surface 191*a* as described above that is sloped in a predetermined direction so as to correspond to the lower part sloping surface 186*b* of the cam part 186. Additionally, it is preferable for a sloping angle of the first sloping surface 191*a* to be, for example, about 18° where a horizontal one is 0°. A top part of the first protrusion part 191, that is, an upper end part of the first sloping surface 191*a* forms the first engaging point 191*b*.

The second protrusion part 192 has the second sloping surface 192*a* as described above. The second sloping surface 192*a* is sloped in a direction that is identical to that of the first sloping surface 191*a*. Additionally, it is also preferable for a sloping angle of the second sloping surface 192*a* to be, for example, about 18° where a horizontal one is 0°. A top part of the second protrusion part 192, that is, an upper end part of the second sloping surface 192*a* forms the second engaging point 192*b*. Sloping angles of the first sloping surface 191*a* and the second sloping surface 192*a* are formed so as to be similar, so that it is possible to execute switching between a valve-opened state and a valve-closed state with identical operational feelings as described later.

The first engaging point 191*b* and the second engaging point 192*b* are arranged side by side with one another. Furthermore, the first engaging point 191*b* and the second engaging point 192*b* are arranged at substantially identical heights, so that it is possible to execute switching between a valve-opened state and a valve-closed state with identical operational feelings as described later.

Respective side surfaces of the first protrusion part 191 and the second protrusion part 192 are provided as the fixation parts 191*c*, 192*c* as described above. The fixation parts 191*c*, 192*c* contact a side surface 186*c* of the cam part 186 of the plunger 183 and the plunger 183 is pushed by the pushing member 185 in a direction as indicated by an arrow D2 in the figure, so that the plunger 183 is fixed in a valve-closed state or a valve-opened state of the manual operation valve 181.

The first protrusion part 191 and the second protrusion part 192 are provided as one set thereof, and a plurality of sets (for example, three sets) thereof are provided at a predetermined interval(s) along a peripheral direction on an inner peripheral surface of the external cylinder member 184 so as to correspond to the cam part 186 of the plunger 183.

Furthermore, the external cylinder member 184 has a cover member 187. The cover member 187 is attached to an upper part of the external cylinder member 184 so as to close an upper part opening 184*a* of the external cylinder member 184. The cover member 187 has, on a central part thereof, an opening part 187*a* where the second wire 31 is inserted therethrough. Additionally, the second wire 31 is inserted through the opening part 187*a* and subsequently is connected to an upper part of the plunger 183.

Furthermore, the cover member 187 has a guide part 195. The guide part 195 has a first guide part 196 and a second guide part 197. Each of the first guide part 196 and the second guide part 197 is formed on a lower part of the guide part 195. The first guide part 196 has a first sloping surface 196*a* that is sloped in a predetermined direction so as to correspond to the upper part sloping surface 186*a* of the cam part 186. Furthermore, the second guide part 197 has a second sloping surface 197*a* that is sloped in a direction that is identical to that of the first sloping surface 196*a*. The upper part sloping surface 186*a* of the cam part 186 of the plunger 183 is slid along one of the first sloping surface 196*a* and the second sloping surface 197*a*, so that the guide part 195 guides movement of the pulled manual operation valve 181 (the plunger 183). Sloping angles of the first sloping surface 196*a* and the second sloping surface 197*a* and top points (the first engaging point 191*b* and the second engaging point 192*b*) of respective sloping surfaces are arranged at substantially identical slopes and heights, so that it is possible to execute switching between a valve-opened state and a valve-closed state with identical operational feelings as described later.

Furthermore, the first guide part 196 and the second guide part 197 are also provided as one set thereof, and a plurality of sets (for example, three sets) thereof are provided at a predetermined interval(s) around the opening part 187*a* so as to surround the opening part 187*a* so as to correspond to the cam part 186 of the plunger 183.

Thus, in the water supply mechanism 199, a nock mechanism is composed of the cam part 186 of the plunger 183, the guide rib 190 of the external cylinder member 184, and the guide part 195 of the cover member 187.

1-7. Operation of Water Supply Mechanism

Figure 7:
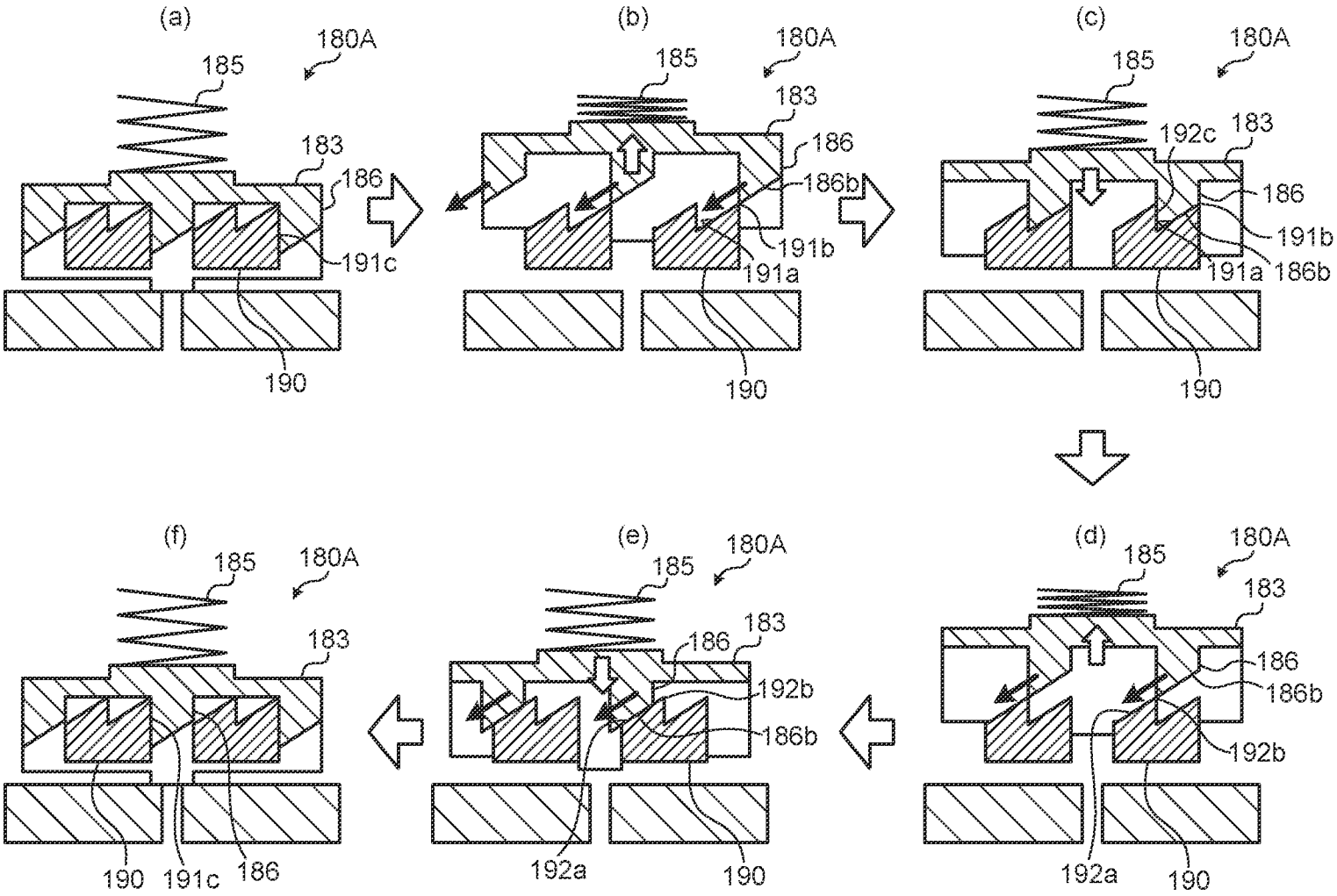
FIG. 7 is an operation explanatory diagram of a switching part (part 1) according to a first embodiment.
Figure 8:
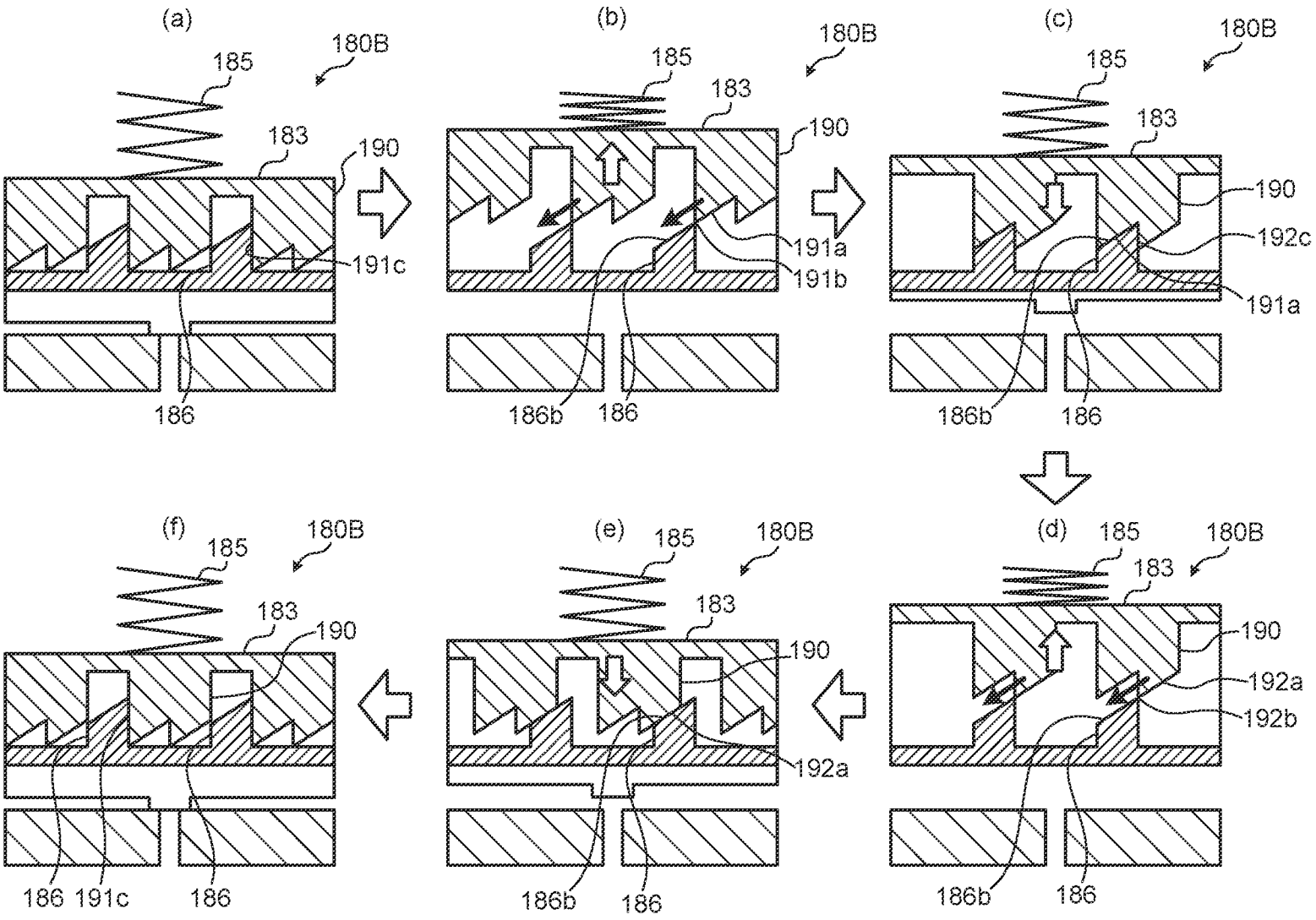
FIG. 8 is an operation explanatory diagram of a switching part (part 2) according to a first embodiment.
Figure 9:
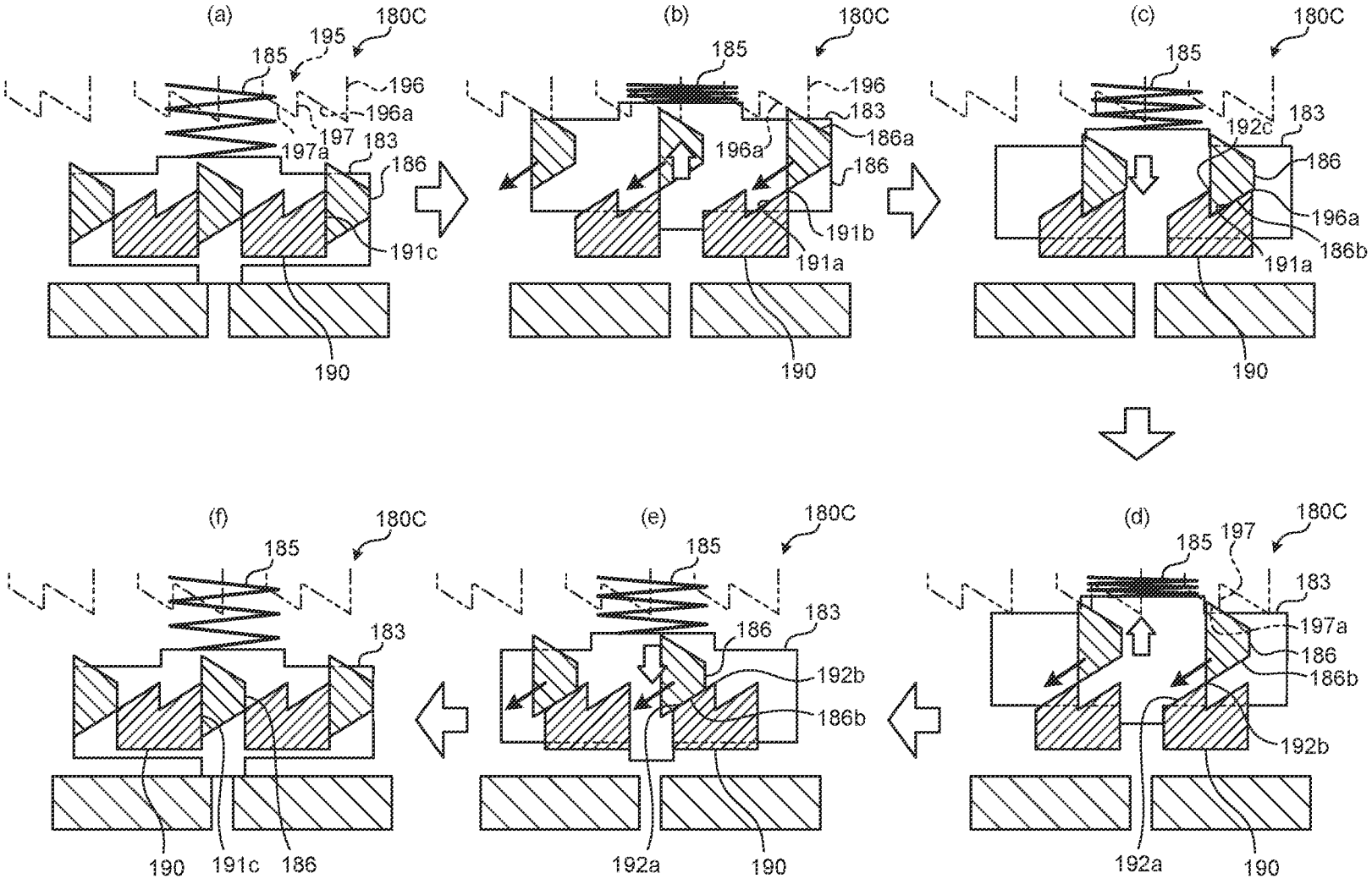
FIG. 9 is an operation explanatory diagram of a switching part (part 3) according to a first embodiment.

Next, an operation of a switching part 180 will be explained with reference to FIG. 7 to FIG. 9. FIG. 7 to FIG. 9 are operation explanatory diagrams of switching parts 180 (180A to 180C) according to a first embodiment. In embodiments in FIGS. 7 and 8, a guide part 195 of a cover member 187 is omitted. In a switching part 180 (180A) in an example as illustrated in FIG. 7, first, in a valve-closed state of a manual operation valve 181 (see FIG. 6) as illustrated in FIG. 7(*a*), a plunger 183 is pushed in a direction where valve closing is executed by a pushing member 185 (downward) and a cam part 186 is fixed by a fixation part 191*c* of a guide rib 190, so that it is held in the valve-closed state.

Then, as the manual operation valve 181 is pulled by an operation of a manual operation part 30 as illustrated in FIG.

7(*b*), the plunger 183 is lifted against a pushing force of the pushing member 185 and the cam part 186 moves beyond a first engaging point 191*b* so as to be provided in a movable state, and as a pull of the manual operation valve 181 is released as illustrated in FIG. 7(*c*), the plunger 183 is pushed by the pushing member 185 and a lower part sloping surface 186*b* of the cam part 186 moves along a first sloping surface 191*a*. The cam part 186 is fixed by a fixation part 192*c* in a middle of returning of the plunger 183 that is pushed by the pushing member 185, so that it is held in a valve-opened state.

Then, as the manual operation valve 181 is pulled by an operation of the manual operation part 30 again as illustrated in FIG. 7(*d*), the plunger 183 is lifted against a pushing force of the pushing member 185 so as to release fixation that is caused by the fixation part 192*c* and the cam part 186 moves beyond a second engaging point 192*b* so as to be provided in a movable state, and as a pull of the manual operation valve 181 is released as illustrated in FIG. 7(*e*), the plunger 183 is pushed by the pushing member 185 and the lower part sloping surface 186*b* of the cam part 186 moves along a second sloping surface 192*a*.

Then, as illustrated in FIG. 7(*f*), the cam part 186 is fixed by the fixation part 191*c*, so that the plunger 183 is held in a valve-closed state.

Furthermore, as illustrated in FIG. 8, a switching part 180 (180B) may be configured in such a manner that a guide rib 190 is provided on a side of a plunger 183 and a cam part 186 is provided on an inner peripheral surface of an external cylinder member 184.

In the switching part 180B in an example as illustrated in FIG. 8, first, in a valve-closed state of a manual operation valve 181 (see FIG. 6) as illustrated in FIG. 8(*a*), the plunger 183 is pushed in a direction where valve closing is executed by a pushing member 185 (downward) and a fixation part 191*c* is fixed to the cam part 186, so that it is held in a valve-closed state.

Then, as the manual operation valve 181 is pulled by an operation of a manual operation part 30 as illustrated in FIG. 8(*b*), the plunger 183 is lifted against a pushing force of the pushing member 185 and a first engaging point 191*b* moves beyond the cam part 186 so as to be provided in a movable state, and as a pull of the manual operation valve 181 is released as illustrated in FIG. 8(*c*), the plunger 183 is pushed by the pushing member 185 and a first sloping surface 191*a* moves along a lower part sloping surface 186*b* of the cam part 186. The cam part 186 is fixed to a fixation part 192*c* in a middle of returning of the plunger 183 that is pushed by the pushing member 185, so that it is held in a valve-opened state.

Then, as the manual operation valve 181 is pulled by an operation of the manual operation part 30 again as illustrated in FIG. 8(*d*), the plunger 183 is lifted against a pushing force of the pushing member 185 so as to release fixation that is caused by the fixation part 192*c* and a second engaging point 192*b* moves beyond the cam part 186 so as to be provided in a movable state, and as a pull of the manual operation valve 181 is released as illustrated in FIG. 8(*e*), the plunger 183 is pushed by the pushing member 185 and a second sloping surface 192*a* moves along the lower part sloping surface 186*b* of the cam part 186.

Then, as illustrated in FIG. 8(*f*), the fixation part 191*c* is fixed to the cam part 186, so that the plunger 183 is held in a valve-closed state.

Furthermore, as illustrated in FIG. 9, a switching part 180 (180C) may be configured in such a manner that movement of a plunger 183 is guided by a guide part 195 of a cover member 187 (see FIG. 6). Additionally, an example as illustrated in FIG. 9 corresponds to a configuration as illustrated in FIG. 6 and FIG. 9 illustrates a guide part that is arranged in a peripheral direction of the cover member 187 in a developed manner.

In the switching part 180C in an example as illustrated in FIG. 9, first, in a valve-closed state of a manual operation valve 181 (see FIG. 6) as illustrated in FIG. 9(*a*), the plunger 183 is pushed in a direction where valve closing is executed by a pushing member 185 (downward) and a cam part 186 is fixed by a fixation part 191*c* of a guide rib 190, so that it is held in a valve-closed state.

Then, as the manual operation valve 181 is pulled by an operation of a manual operation part 30 as illustrated in FIG. 9(*b*), the plunger 183 is lifted against a pushing force of the pushing member 185 and the cam part 186 moves beyond a first engaging point 191*b* so as to be provided in a movable state. As the plunger 183 is lifted, an upper part sloping surface 186*a* of the cam part 186 contacts a first sloping surface 196*a* of a first guide part 196 and the upper part sloping surface 186*a* moves along the first sloping surface 196*a*. Thus, the first guide part 196 guides movement of the plunger 183 in a peripheral direction thereof.

Then, as a pull of the manual operation valve 181 is released as illustrated in FIG. 9(*c*), the plunger 183 that moves in a peripheral direction while being guided by the guide part 195 is pushed by the pushing member 185 and a lower part sloping surface 186*b* of the cam part 186 moves along a first sloping surface 191*a*. The cam part 186 is fixed by a fixation part 192*c* in a middle of returning of the plunger 183 that is pushed by the pushing member 185, so that it is held in a valve-opened state.

Then, as the manual operation valve 181 is pulled by an operation of the manual operation part 30 again as illustrated in FIG. 9(*d*), the plunger 183 is lifted against a pushing force of the pushing member 185 so as to release fixation that is caused by the fixation part 192*c* and the cam part 186 moves beyond a second engaging point 192*b* so as to be provided in a movable state. As the plunger 183 is lifted, the upper part sloping surface 186*a* of the cam part 186 contacts a second sloping surface 197*a* of a second guide part 197 and the upper part sloping surface 186*a* moves along the second sloping surface 197*a*. Thus, the second guide part 197 guides movement of the plunger 183 in a peripheral direction thereof.

Then, as a pull of the manual operation valve 181 is released as illustrated in FIG. 9(*e*), the plunger 183 that moves in a peripheral direction while being guided by the guide part 195 is pushed by the pushing member 185 and the lower part sloping surface 186*b* of the cam part 186 moves along a second sloping surface 192*a*.

Then, as illustrated in FIG. 9(*f*), the cam part 186 is fixed by the fixation part 191*c*, so that the plunger 183 is held in a valve-closed state.

1-8. Toilet Washing Operation at Time of Power Failure

Figure 10A:
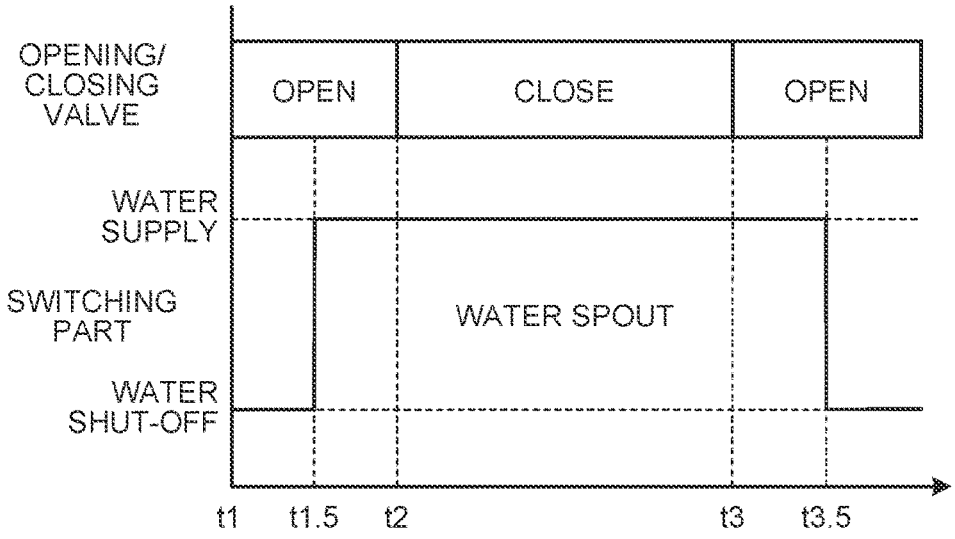
Figure 10B:
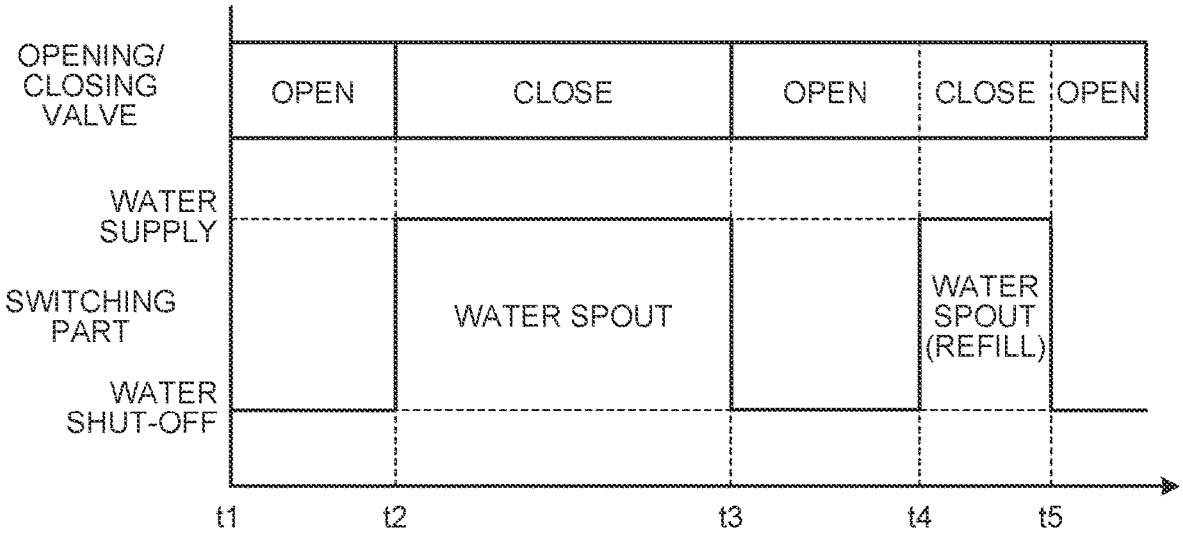
Figure 11A:
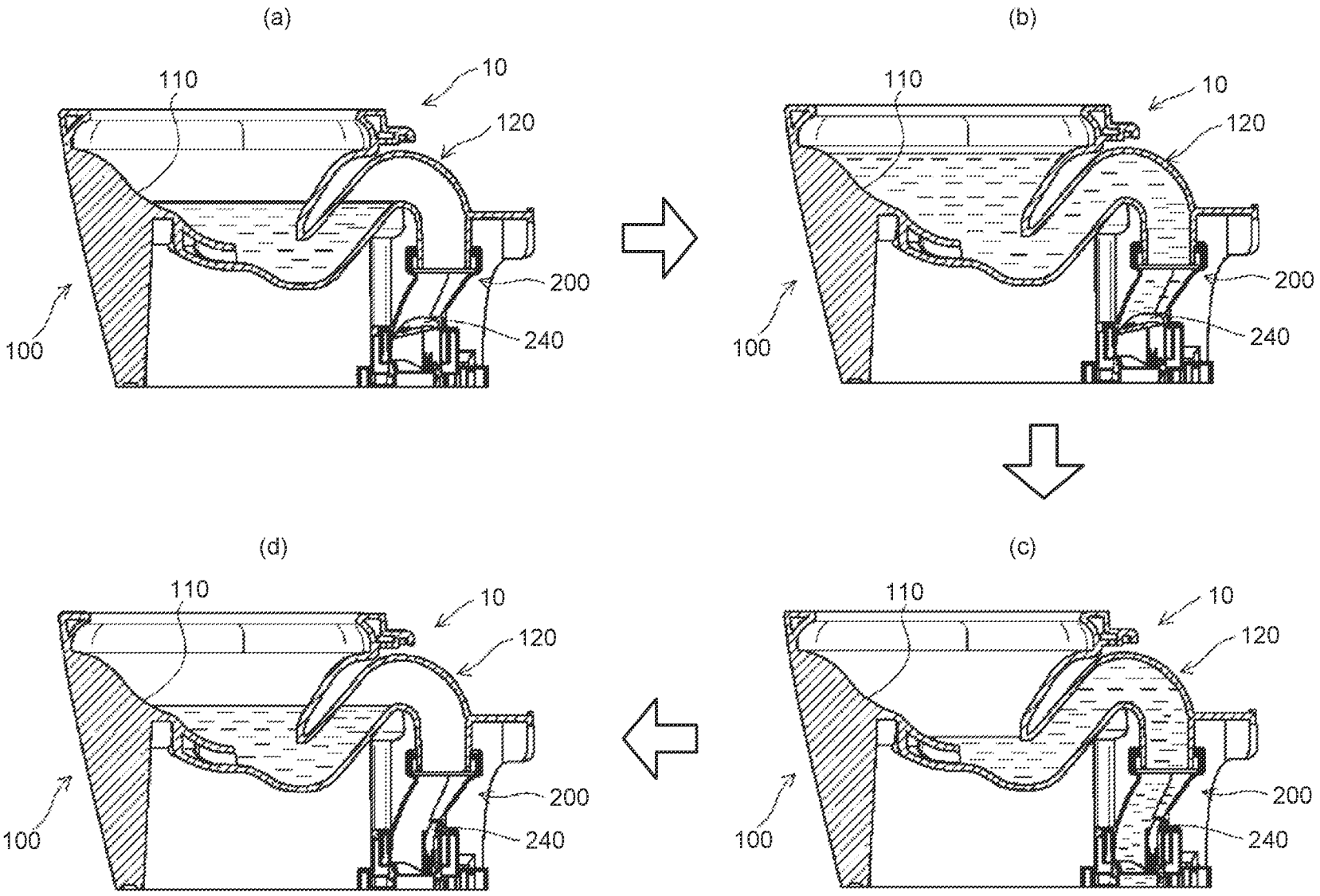
FIG. 11A is an explanatory diagram of an example of a toilet washing operation at a time of power failure.
Figure 11B:
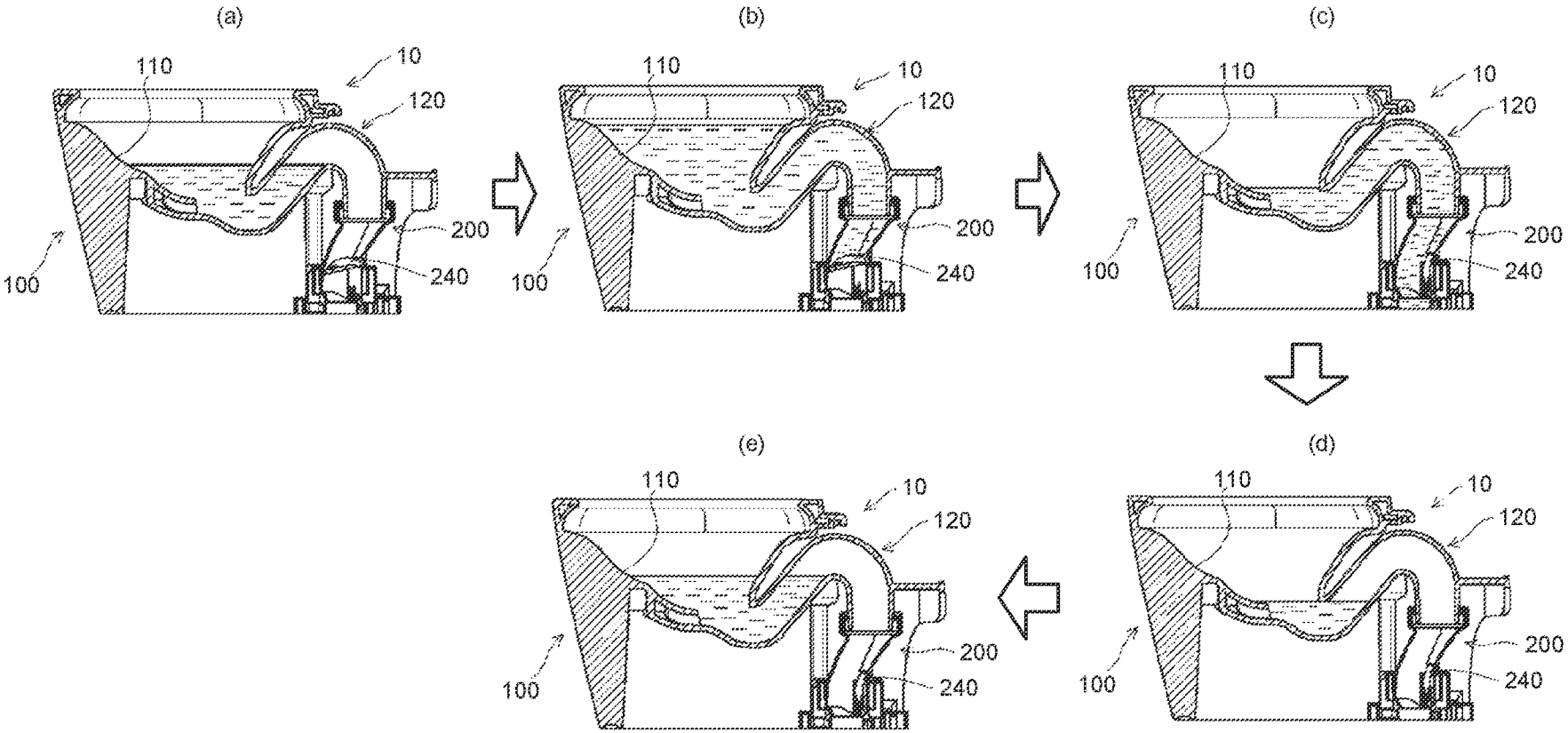
FIG. 11B is an explanatory diagram of another example of a toilet washing operation at a time of power failure.

Next, a toilet washing operation at a time of power failure will be explained with reference to FIG. 10A to FIG. 11B. FIG. 10A is a timing chart that illustrates an example of an opening/closing timing of an opening/closing valve 240 at a time of power failure and water supply and water shut-off timings for a bowl part 110 in a switching part 180. FIG. 10B is a timing chart that illustrates another example of an opening/closing timing of an opening/closing valve 240 at a time of power failure and water supply and water shut-off timings for a bowl part 110 in a switching part 180. FIG. 11A is an explanatory diagram of an example of a toilet washing operation at a time of power failure. FIG. 11B is an explanatory diagram of another example of a toilet washing operation at a time of power failure. Additionally, FIG. 11A illustrates an operation example that corresponds to a timing chart as illustrated in FIG. 10A and FIG. 11B illustrates an operation example that corresponds to a timing chart as illustrated in FIG. 10B.

As illustrated in FIG. 10A, in an example of an opening/closing timing of the opening/closing valve 240 at a time of power failure and water supply and water shut-off timings for the bowl part 110 in the switching part 180, a state where the opening/closing valve 240 is provided in an opened state, that is, a flow path cross-sectional area of a connection flow path 211 is not changed (timing t1 in FIG. 10A) is provided before a user executes an excretion action. Furthermore, the switching part 180 is provided in a water shut-off state where water supply to the bowl part 110 is not executed.

A user manually operates each of a first operation part 20 and a second operation part 30 so as to operate both the opening/closing valve 240 and the switching part 180 after executing an excretion action at a time of power failure. Specifically, for example, a user grasps the first operation part 20 and pulls a first wire 21 by one hand thereof, and grasps the second operation part 30 and pulls a second wire 31 by another hand thereof. Thereby, the opening/closing valve 240 is rotated around an axis of rotation 243 that is connected to the first wire 21 as a center, so as to provide a state where the opening/closing valve 240 is provided in a closed state, that is, a flow path cross-sectional area of a socket body 210 is decreased by the opening/closing valve 240 (timing t1 in FIG. 10A and FIG. 11A(a)).

On the other hand, in the switching part 180 that is connected to the second wire 31, a manual operation valve 181 is moved so as to open a pilot flow path 312. Thereby, an internal pressure of a pressure chamber 311 is decreased and a diaphragm 310 is moved so as to separate from a valve seat 313 (see FIG. 5), so that a water supply state is provided where a water supply path 151 (see FIG. 5) is opened (timing t1.5 in FIG. 10A). A user stops a manual operation of the second operation part 30 (for example, returns the pulled second operation part 30) so as to maintain a state where the manual operation valve 181 (a plunger 183) of the switching part 180 is moved, that is, maintain a water supply state, so that the second wire 31 does not have to be continuously pulled by grasping the second operation part 30.

Thereby, it is possible to supply washing water to the bowl part 110 from at least one of a rim water spout port 113 and a jet water spout port 111 at a time of power failure. As described above, the opening/closing valve 240 is provided in a closed state where the connection flow path 211 (see FIG. 2A and FIG. 2B) is closed, so that washing water is stored in the bowl part 110 so as to raise a water level in the bowl part 110 as illustrated in FIG. 11A(b). After the second operation part 30 is manually operated and such a manual operation of the second operation part 30 is stopped so as to maintain a water supply state, the first operation part 20 is operated, so that it is possible to execute an operation by one hand even if a flush toilet 10 (see FIG. 1) is arranged in a narrow space.

Then, as a water level inside the bowl part 110 is a water level that is capable of washing the bowl part 110, a user stops a manual operation of the first operation part 20 (for example, returns the pulled first operation part 20). Herein, "a water level that is capable of washing the bowl part 110" is, for example, a water level that is capable of draining or capable of replacing water inside the bowl part 110. Alternatively, "a water level that is capable of washing the bowl part 110" is, for example, a water level that is capable of causing a siphon action.

As a manual operation of the second operation part 30 is executed and subsequently the manual operation is stopped, maintenance of a state where the manual operation valve 181 (the plunger 183) of the switching part 180 is moved is released, so that, in the switching part 180, the plunger 183 is moved by a pushing force of a pushing member 185 so as to close the pilot flow path 312. Thereby, an internal pressure of the pressure chamber 311 is increased and the diaphragm 310 is moved toward the valve seat 313, so that a water shut-off state is provided where the water supply path 151 is closed (timing t3.5 in FIG. 10A). Thereby, supply of washing water to the bowl part 110 is stopped.

Furthermore, as the opening/closing valve 240 is provided in an opened state (timing t3 in FIG. 10A), washing water that is stored in the bowl part 110 flows into a drainage water trap pipe line 120 as illustrated in FIG. 11A(c) and (d), the drainage water trap pipe line 120 is filled with water, and a siphon action is caused so as to drain a large amount of washing water that is retained in the bowl part 110. In addition thereto, a user maintains a water supply state so as to supply washing water to the bowl part 110 (timings t3 to t3.5 in FIG. 10A) and execute refill for preventing an odor or the like from a water drainage pipe 300 (see FIG. 2A and FIG. 2B) from flowing back to a room interior. Thus, stops of manual operations of the first operation part 20 and the second operation part 30 do not have to be executed simultaneously, and for example, as a water level inside the bowl part 110 is a water level that is capable of washing the bowl part 110, a user stops a manual operation of the first operation part 20, maintains a water supply state for a certain period of time so as to wash an inside of a toilet, subsequently manually operates the second operation part 30, and stops such a manual operation so as to end the water supply state.

As illustrated in FIG. 11A(d), a user stops a manual operation of the first operation part 20, manually operates the second operation part 30, and subsequently stops such a manual operation. Thereby, supply of washing water to the bowl part 110 is stopped (timing t3.5 in FIG. 10A). Thus, a water level in the bowl part 110 is returned to a neighborhood of an initial water level (refill is executed) so as to stabilize the initial water level, so that it is possible to prevent or reduce overflowing of water inside the bowl part 110 from a bowl surface or entry of an odor or the like from the water drainage pipe 300 to a room interior.

Furthermore, as illustrated in FIG. 10B, in another example of an opening/closing timing of the opening/closing valve 240 at a time of power failure and water supply and water shut-off timings for the bowl part 110 in the switching part 180, a state where the opening/closing valve 240 is provided in an opened state, that is, a flow path cross-sectional area of a connection flow path 211 is not changed (timing t1 in FIG. 10B) is provided before a user executes an excretion action. Furthermore, the switching part 180 is provided in a water shut-off state where water supply to the bowl part 110 is not executed.

A user manually operates each of a first operation part 20 and a second operation part 30 so as to operate both the opening/closing valve 240 and the switching part 180 after executing an excretion action at a time of power failure. Specifically, for example, a user grasps the first operation part 20 and pulls a first wire 21 by one hand thereof, and grasps the second operation part 30 and pulls a second wire 31 by another hand thereof. Thereby, the opening/closing valve 240 is rotated around an axis of rotation 243 that is connected to the first wire 21 as a center, so as to provide a state where the opening/closing valve 240 is provided in a closed state, that is, a flow path cross-sectional area of a socket body 210 is decreased by the opening/closing valve 240 (timing t2 in FIG. 10B and FIG. 11B(a)).

On the other hand, in the switching part 180 that is connected to the second wire 31, a manual operation valve 181 is moved so as to open a pilot flow path 312. Thereby, an internal pressure of a pressure chamber 311 is decreased and a diaphragm 310 is moved so as to separate from a valve seat 313 (see FIG. 5), so that a water supply state is provided where a water supply path 151 (see FIG. 5) is opened (timing t2 in FIG. 10B). A user stops a manual operation of the second operation part 30 (for example, returns the pulled second operation part 30) so as to maintain a state where the manual operation valve 181 (a plunger 183) of the switching part 180 is moved, that is, maintain a water supply state, so that the second wire 31 does not have to be continuously pulled by grasping the second operation part 30.

Thereby, it is possible to supply washing water to the bowl part 110 from at least one of a rim water spout port 113 and a jet water spout port 111 at a time of power failure. As described above, the opening/closing valve 240 is provided in a closed state where the connection flow path 211 (see FIG. 2A and FIG. 2B) is closed, so that washing water is stored in the bowl part 110 so as to raise a water level in the bowl part 110 as illustrated in FIG. 11B(b). Additionally, the first operation part 20 may be manually operated after manually operating the second operation part 30 so as to provide a water supply state. After the second operation part 30 is manually operated and such a manual operation of the second operation part 30 is stopped so as to maintain a water supply state, the first operation part 20 is operated, so that it is possible to execute an operation by one hand even if a flush toilet 10 (see FIG. 1) is arranged in a narrow space.

Then, as a water level inside the bowl part 110 is a water level that is capable of washing the bowl part 110, a user stops a manual operation of the first operation part 20 (for example, returns the pulled first operation part 20). Herein, "a water level that is capable of washing the bowl part 110" is, for example, a water level that is capable of draining or capable of replacing water inside the bowl part 110. Alternatively, "a water level that is capable of washing the bowl part 110" is, for example, a water level that is capable of causing a siphon action.

As a manual operation of the second operation part 30 is executed and subsequently the manual operation is stopped, maintenance of a state where the manual operation valve 181 (the plunger 183) of the switching part 180 is moved is released, so that, in the switching part 180, the plunger 183 is moved by a pushing force of a pushing member 185 so as to close the pilot flow path 312. Thereby, an internal pressure of the pressure chamber 311 is increased and the diaphragm 310 is moved toward the valve seat 313, so that a water shut-off state is provided where the water supply path 151 is closed (timing t3 in FIG. 10B). Thereby, supply of washing water to the bowl part 110 is stopped.

Furthermore, as manual operations of the first operation part 20 and the second operation part 30 are stopped, the opening/closing valve 240 is provided in an opened state (timing t5 in FIG. 10B). Accordingly, washing water that is stored in the bowl part 110 flows into a drainage water trap pipe line 120 as illustrated in FIG. 11B(c), the drainage water trap pipe line 120 is filled with water, and a siphon action is caused so as to drain a large amount of washing water that is retained in the bowl part 110. Stops of manual operations of the first operation part 20 and the second operation part 30 do not have to be executed simultaneously, and for example, as a water level inside the bowl part 110 is a water level that is capable of washing the bowl part 110, a user may stop a manual operation of the first operation part 20, maintain a water supply state for a certain period of time so as to wash an inside of a toilet, subsequently manually operate the second operation part 30, and stop such a manual operation so as to end the water supply state.

Herein, for example, as a water level in the bowl part 110 is lowered by a water drainage operation as described above as illustrated in FIG. 11B(d), an odor or the like from a water drainage pipe 300 (see FIG. 2A and FIG. 2B) may flow back to a room interior, so that a user supplies washing water to the bowl part 110 again (refill).

Specifically, the first operation part 20 and the second operation part 30 are manually operated again. It is possible to maintain a water supply state by stopping a manual operation of the second operation part 30. Thereby, in the switching part 180, a state is provided where a water supply state where the water supply path 151 is opened is maintained as described above, so that washing water is supplied to the bowl part 110 (timing t4 in FIG. 10B).

Then, as a lowered water level in the bowl part 110 is returned to a neighborhood of an initial water level as illustrated in FIG. 11B(e), a user stops a manual operation of the first operation part 20, manually operates the second operation part 30, and subsequently stops such a manual operation. Thereby, supply of washing water to the bowl part 110 is stopped (timing t5 in FIG. 10B). Thus, a water level in the bowl part 110 is returned to neighborhood of an initial water level (refill is executed) so as to stabilize the initial water level, so that it is possible to prevent or reduce overflowing of water inside the bowl part 110 from a bowl surface or entry of an odor or the like from the water drainage pipe 300 to a room interior.

Thus, in the present embodiment, both the opening/closing valve 240 and the switching part 180 are operated by manual operations of a user for the first operation part 20 and the second operation part 30, so that it is possible to execute toilet washing without limiting a number of times of washing, even at a time of power failure. Furthermore, in a case where refill is executed, only the second operation part 30 may be manually operated without manually operating the first operation part 20.

Additionally, although refill is executed in an example as described above, this is not limiting, and refill may be omitted, for example, in a case where a water level in the bowl part 110 is not lowered by a water drainage operation but is provided near an initial water level. As illustrated in FIG. 10A, for example, refill may be executed after stopping a manual operation of the first operation part 20 at timing t3 in the figure, subsequently executing water supply for a certain period of time (timings t3 to t3.5 in the figure), manually operating the second operation part 30, and executing a stop thereof so as to end water supply, without executing refill separately.

In the switching part 180 according to a first embodiment as explained above, it is possible to maintain a valve-opened state of the manual operation valve 181 that is provided in the valve-opened state by being pulled, even when a pull thereof is released. Hence, a user does not have to continue to operate the manual operation part (second operation part) 30 (continue to pull the manual operation valve 181), so that it is possible for a user to execute water supply by a simple operation. Thereby, it is possible to reduce a load of toilet washing on a user at a time of power failure.

Furthermore, a structure is provided where it is possible to maintain a valve-opened state by releasing a pull of the manual operation valve 181, so that it is possible to prevent or reduce breakage of the second operation part 30, the second wire 31, and/or the like. Moreover, the manual operation valve 181 is provided in a valve-opened state by a pull operation of the second operation part 30, so that it is possible for a user to confirm that water supply is stared and subsequently end the pull operation so as to maintain the valve-opened state. Hence, it is possible to prevent an operation mistake such as ending water supply before the manual operation valve 181 is provided in a valve-opened state by an insufficient pull or the like.

Furthermore, it is possible to provide a valve-closed state of the manual operation valve 181 according to an operation method that is identical to an operation method for providing a valve-opened state. Hence, complication of an operation is prevented or reduced, so that it is possible for a user to execute water shut-off by a simple operation. Thereby, it is possible to further reduce a load of toilet washing on a user at a time of power failure. Furthermore, a structure where a pull of the manual operation valve 181 is released so as to end maintenance of a valve-opened state without depending on an operational force and/or an operation method of a user (a structure for providing a valve-closed state) is provided, so that, for example, it is possible to prevent or reduce breakage of the second operation part 30, the second wire 31, and/or the like that is caused by an excess pull of a user.

Furthermore, it is possible for a user to feel a click feeling that is produced at a time when the plunger 183 moves beyond the first protrusion part 191 or the second protrusion part 192. Thereby, it is possible for a user to readily recognize that the plunger 183 moves beyond a first engaging point 191*b* or a second engaging point 192*b* by a pull operation of the second operation part 30.

Furthermore, the first engaging point 191*b* and the second engaging point 192*b* are arranged at substantially identical heights, so that it is possible for a user to execute an operation that maintains a valve-opened state of the manual operation valve 181 (a valve opening operation) and an operation that releases the valve-opened state of the manual operation valve 181 (a valve closing operation) with identical operational feelings.

Furthermore, in the flush toilet 10 according to a first embodiment, a user does not have to continue to operate the second operation part 30 (continue to pull the manual operation valve 181) in a water supply mechanism 199, so that it is possible for a user to execute water supply by a simple operation. Thereby, it is possible to reduce a load of toilet washing on a user at a time of power failure.

2. Second Embodiment

Figure 12:
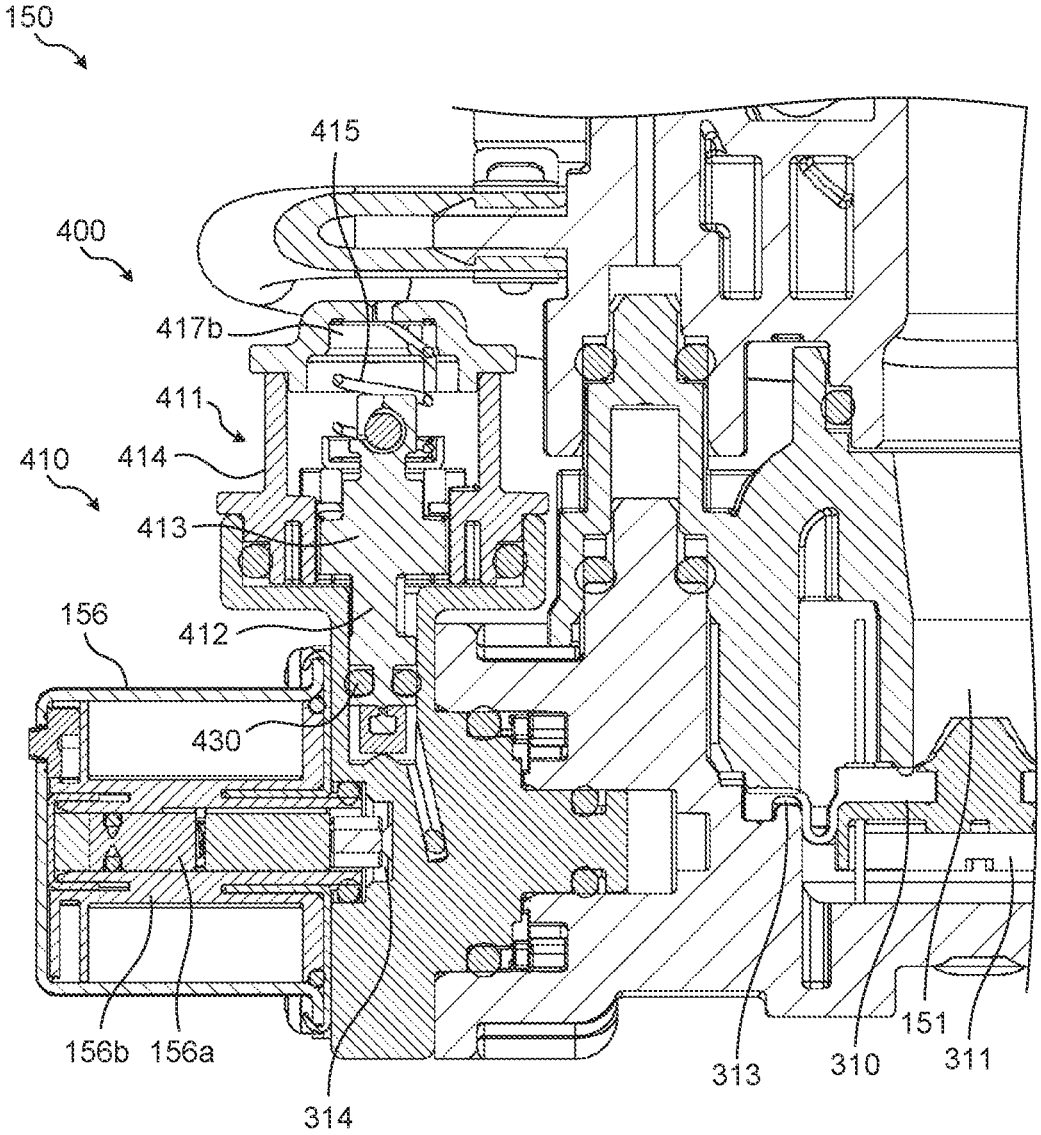
FIG. 12 is a schematic cross-sectional view of a toilet washing device according to a second embodiment.
Figure 13:
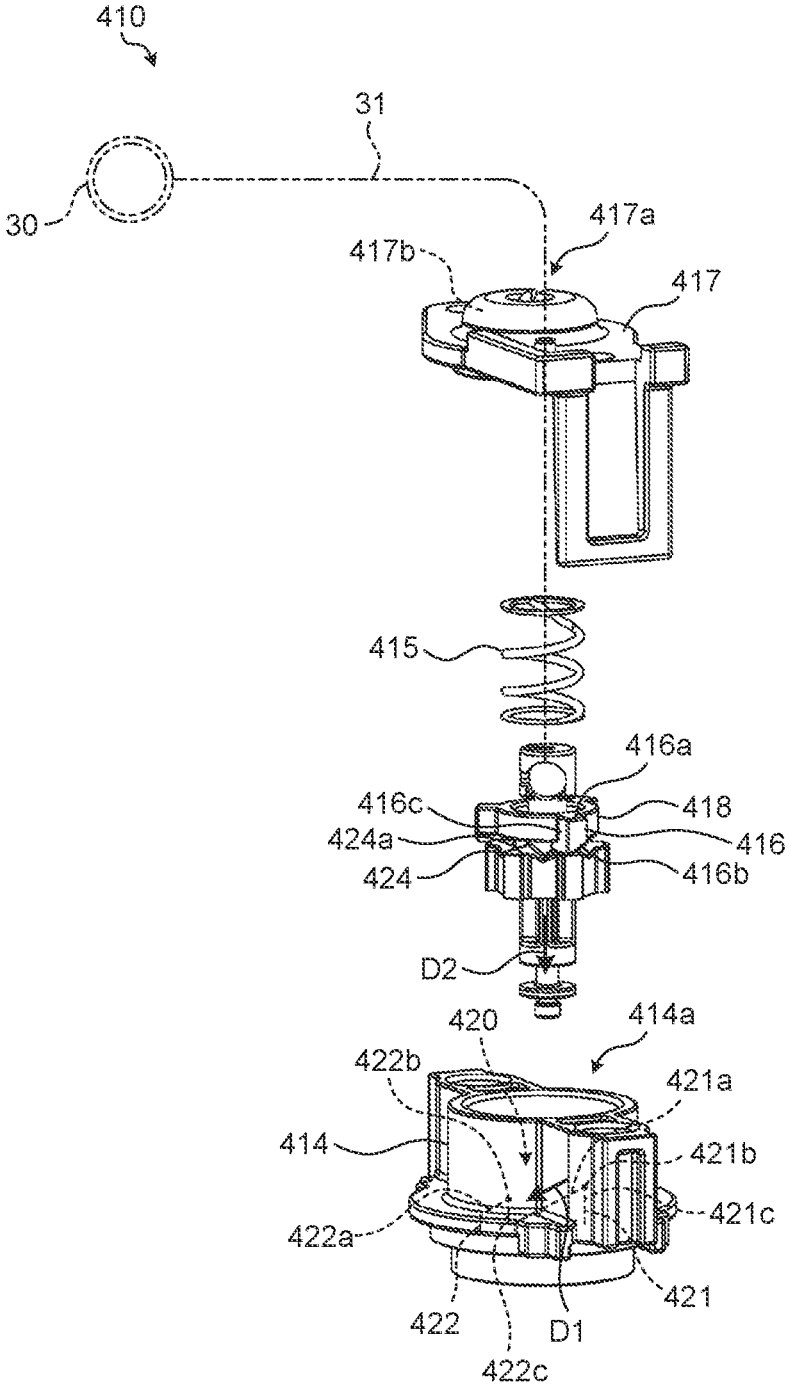
FIG. 13 is a schematic exploded perspective view that illustrates a switching part according to a second embodiment.
Figure 14:
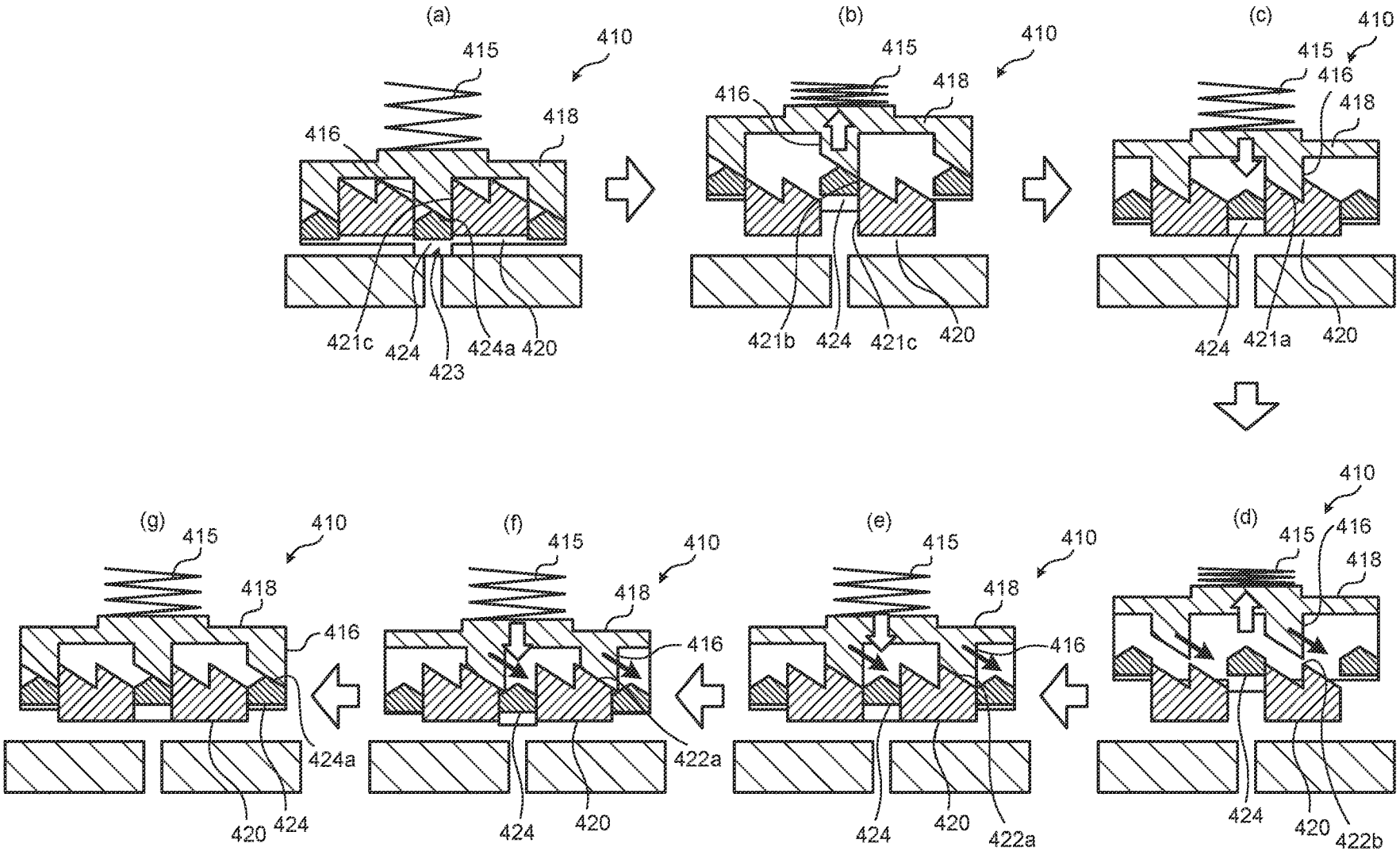
FIG. 14 is an operation explanatory diagram of a switching part according to a second embodiment.

Next, a water supply mechanism 400 (and a flush toilet 10) according to a second embodiment will be explained with reference to FIG. 12 to FIG. 14. FIG. 12 is a schematic cross-sectional view of a toilet washing device 150 according to a second embodiment. Additionally, FIG. 12 is a schematic cross-sectional view near a water supply mechanism 400 in the toilet washing device 150. FIG. 13 is a schematic exploded perspective view that illustrates a switching part 410 according to a second embodiment. FIG. 14 is an operation explanatory diagram of a switching part 410 according to a second embodiment.

Additionally, a second embodiment is different from a first embodiment as described above mainly in a configuration of the switching part 410 of the water supply mechanism 400. Hence, in an explanation as provided below, a site that is identical or equivalent to that of a first embodiment may be provided with an identical sign, and further, for a site that is provided with an identical sign, an explanation thereof may be omitted.

As illustrated in FIG. 12, the switching part 410 includes a manual operation valve 411 and a cam part. It is possible for a user to execute a manual operation of the manual operation valve 411 through a second operation part 30 (see FIG. 3). The manual operation valve 411 is, for example, a poppet valve. As a second wire 31 of the second operation part 30 is manually operated by a user, an operational force of a manual operation is transmitted to a shaft, so that the shaft is rotated around a predetermined axis of rotation.

A cam part is provided on an end part of a rotatable shaft as described above. Hence, a cam part is also rotated around a predetermined axis of rotation in association with rotation of a shaft that is caused by a manual operation of the second operation part 30.

The manual operation valve 411 is provided on a pilot flow path 312. The manual operation valve 411 includes a valve body 412, a plunger 413, an external cylinder member 414, and a pushing member 415. The switching part 410 that includes such a manual operation valve 411, and an electromagnetic valve 156, the second operation part 30, the second wire 31, or the like compose the water supply mechanism 400 for washing water in the toilet washing device 150.

The manual operation valve 411 opens or closes a bypass path 314. The plunger 413 is inserted through an insertion hole near a center of the valve body 412 and is fixed in an inserted state. The valve body 412 is held so as to be watertight by an O-ring 430 that is arranged in a peripheral direction and is capable of being slid in an axial direction. The plunger 413 is a member with an elongated shape and is arranged in such a manner that a tip thereof penetrates the bypass path 314 and protrudes to a neighborhood of a cam part that is positioned on a downstream side of the electromagnetic valve 156 on the pilot flow path 312.

The external cylinder member 414 is a member with a cylindrical shape (preferably, a circularly cylindrical shape) and is fixed at an appropriate position near an inlet of the pilot flow path 312. Additionally, a flow path where water that flows out from a pressure chamber 311 is capable of flowing is formed on the external cylinder member 414.

The pushing member 415 is, for example, a coil spring and is arranged between the plunger 413 and the external cylinder member 414. The pushing member 415 presses the valve body 412 so as to close it. In other words, the pushing member 415 pushes the plunger 413 and/or the valve body 412 so as to provide a valve-closed state.

The switching part 410 that is configured as described above is operated according to a manual operation of a user for the second operation part 30 (see FIG. 3). Specifically, as the second operation part 30 is operated, a cam part is rotated, and by rotation of the cam part, the plunger 413 receives a force that is a pushing force of the pushing member 415 and a water pressure on the pilot flow path 312, so that the valve body 412 is opened so as to open the pilot flow path 312.

As illustrated in FIG. 13, the switching part 410 includes the electromagnetic valve 156, the manual operation part (second operation part) 30, and the transmission part (second wire) 31.

Each of the electromagnetic valve 156 and the switching part 410 executes switching between water supply and water shut-off for a bowl part 110 (see FIG. 1). The switching part 410 includes the manual operation valve 411 (see FIG. 12), is capable of executing a manual operation through the second operation part 30, and includes the valve body 412, the plunger 413, the external cylinder member 414, the pushing member 415, and a rotor 418. In the water supply mechanism 400, the manual operation valve 411 is pulled by the second wire 31 in a direction opposite to a pushing direction of the pushing member 415 so as to be provided in a valve-opened state.

Furthermore, the switching part 410 has a first engaging point 421*b* and a second engaging point 422*b*. Furthermore, the switching part 410 has fixation parts 421*c*, 422*c*. Any of the first engaging point 421*b*, the second engaging point 422*b*, and the fixation parts 421*c*, 422*c* is enclosed in the external cylinder member 414. Additionally, details of the first engaging point 421*b*, the second engaging point 422*b*, and the fixation parts 421*c*, 422*c* will be described later.

The plunger 413 is formed substantially integrally with the valve body 412 that is arranged on a lower part thereof. The plunger 413 is enclosed in the external cylinder member 414. The plunger 413 has a mountain-shaped rib 424 that is provided on an outer peripheral surface thereof. The mountain-shaped rib 424 has sloping surfaces 424*a* that are sloped downward in directions opposite to one another on an upper part thereof. Furthermore, the mountain-shaped rib 424 is formed at a height that is substantially identical to that of a recessed part 423 between a plurality of guide ribs 420 as described later.

The external cylinder member 414 has a guide rib 420 that is provided on an inner peripheral surface thereof. In other words, the guide rib 420 is enclosed in the external cylinder member 414. The guide rib 420 has a first sloping surface 421*a* and a second sloping surface 422*a* that are two sloping surfaces. As the manual operation valve 411 (the plunger 413) is pulled, the lower part sloping surface 416*b* of a cam part 416 of the rotor 418 as described later is slid along one of the first sloping surface 421*a* and the second sloping surface 422*a*, so that the guide rib 420 guides the plunger 413 in a predetermined movement direction as indicated by an arrow D1 in the figure.

The guide rib 420 has a first protrusion part 421 and a second protrusion part 422. Each of the first protrusion part 421 and the second protrusion part 422 is formed on an upper part of the guide rib 420. The first protrusion part 421 has the first sloping surface 421*a* as described above that is sloped in a predetermined direction so as to correspond to the lower part sloping surface 416*b* of the cam part 416 of the rotor 418. A top part of the first protrusion part 421, that is, an upper end part of the first sloping surface 421*a* forms the first engaging point 421*b*.

The second protrusion part 422 has the second sloping surface 422*a* as described above. The second sloping surface 422*a* is sloped in a direction that is identical to that of the first sloping surface 421*a*. A top part of the second protrusion part 422, that is, an upper end part of the second sloping surface 422*a* forms the second engaging point 422*b*. Sloping angles of the first sloping surface 421*a* and the second sloping surface 422*a* are formed so as to be similar, so that it is possible to execute switching between a valve-opened state and a valve-closed state with identical operational feelings.

The first engaging point 421*b* and the second engaging point 422*b* are arranged side by side with one another. Furthermore, the first engaging point 421*b* and the second engaging point 422*b* are arranged at substantially identical heights, so that it is possible to execute switching between a valve-opened state and a valve-closed state with identical operational feelings.

Respective side surfaces of the first protrusion part 421 and the second protrusion part 422 are provided as the fixation parts 421*c*, 422*c* as described above. The fixation parts 421*c*, 422*c* contact a side surface 416*c* of the cam part 416 of the rotor 418 and the plunger 413 is pushed by the pushing member 415 in a direction as indicated by an arrow D2 in the figure, so that the plunger 413 is fixed in a valve-closed state or a valve-opened state of the manual operation valve 181.

The first protrusion part 421 and the second protrusion part 422 are provided as one set thereof, and a plurality of sets (for example, three sets) thereof are provided at a predetermined interval(s) along a peripheral direction on an inner peripheral surface of the external cylinder member 414 so as to correspond to the cam part 416 of the rotor 418.

Furthermore, the external cylinder member 414 has a cover member 417. The cover member 417 is attached to an upper part of the external cylinder member 414 so as to close an upper part opening 414*a* of the external cylinder member 414. The cover member 417 has, on a central part thereof, an opening part 417*a* where the second wire 31 is inserted therethrough. Additionally, the second wire 31 is inserted through the opening part 417*a* and subsequently is connected to an upper part of the plunger 413.

The rotor 418 is a member with a ring shape and is arranged coaxially on an upper part of the plunger 413. The rotor 418 has the cam part 416 that is provided on an outer peripheral surface thereof. The cam part 416 is formed into a block shape and has an upper part sloping surface 416*a* and a lower part sloping surface 416*b*. A plurality of (for example, three) cam parts 416 are provided at a predetermined interval(s) along a peripheral direction on an outer peripheral surface of the rotor 418. Furthermore, the cam part 416 is arranged above the mountain-shaped rib 424. Furthermore, the upper part sloping surface 416*a* and the lower part sloping surface 416*b* are sloped at sloping angles that are substantially identical to those of the sloping surfaces 424*a* of the mountain-shaped rib 424.

Thus, also in the switching part 410, a nock mechanism is composed of the mountain-shaped rib 424 of the plunger 413, the cam part 416 of the rotor 418, and the guide rib 420 of the external cylinder member 414.

Furthermore, in such a switching part 410, first, as illustrated in FIG. 14(*a*), in a valve-closed state of the manual operation valve 411 (see FIG. 13), the plunger 413 is pushed in a direction where valve closing is executed by the pushing member 415 (downward) and the cam part 416 of the rotor 418 is fixed by the fixation part 421*c* of the guide rib 420, so as to be held in the valve-closed state.

Then, as illustrated in FIG. 14(*b*), as the manual operation valve 411 is pulled by an operation of the manual operation part 30, the plunger 413 is lifted against a pushing force of the pushing member 415 and the cam part 416 of the rotor 418 moves beyond the first engaging point 421*b* so as to be provided in a movable state, and as illustrated in FIG. 14(*c*), as a pull of the manual operation valve 411 is released, the plunger 413 is pushed by the pushing member 415 and the lower part sloping surface 416*b* of the cam part 416 moves along the first sloping surface 421*a*. The cam part 416 is fixed by the fixation part 422*c* in a middle of returning of the plunger 413 that is pushed by the pushing member 415, so as to be held in a valve-opened state.

Then, as illustrated in FIG. 14(*d*), as the manual operation valve 411 is pulled by an operation of the manual operation part 30 again, the plunger 413 is lifted against a pushing force of the pushing member 415, fixation that is caused by the fixation part 422*c* is released, and the cam part 416 moves beyond the second engaging point 422*b* so as to be provided in a movable state, and as illustrated in FIG. 14(*e*) and FIG. 14(*f*), as a pull of the manual operation valve 411 is released, the plunger 413 is pushed by the pushing member 415 and the lower part sloping surface 416*b* of the cam part 416 moves along the second sloping surface 422*a*.

Then, as illustrated in FIG. 14(*g*), the cam part 416 is fixed by the fixation part 421*c*, so that the plunger 413 is held in a valve-closed state.

In the water supply mechanism 400 according to a second embodiment, it is possible to maintain a valve-opened state of the manual operation valve 411 that is provided in the valve-opened state by being pulled, even when a pull thereof is released, similarly to a first embodiment as described above. Hence, a user does not have to continue to operate the manual operation part (second operation part) 30 (continue to pull the manual operation valve 411), so that it is possible for a user to execute water supply by a simple operation. Thereby, it is possible to reduce a load of toilet washing on a user at a time of power failure.

Furthermore, a structure is provided where it is possible to maintain a valve-opened state by releasing a pull of the manual operation valve 411, so that it is possible to prevent or reduce breakage of the second operation part 30, the second wire 31, and/or the like. Moreover, the manual operation valve 411 is provided in a valve-opened state by a pull operation of the second operation part 30, so that it is possible for a user to confirm that water supply is started and subsequently end the pull operation so as to maintain the valve-opened state. Hence, it is possible to prevent an operation mistake such as ending water supply before the manual operation valve 411 is provided in a valve-opened state by an insufficient pull or the like.

Furthermore, it is possible to provide a valve-closed state of the manual operation valve 411 according to an operation method that is identical to an operation method for providing a valve-opened state. Hence, complication of an operation is prevented or reduced, so that it is possible for a user to execute water shut-off by a simple operation. Thereby, it is possible to further reduce a load of toilet washing on a user at a time of power failure. Furthermore, a structure where a pull of the manual operation valve 411 is released so as to end maintenance of a valve-opened state without depending on an operational force and/or an operation method of a user (a structure for providing a valve-closed state) is provided, so that, for example, it is possible to prevent or reduce breakage of the second operation part 30, the second wire 31, and/or the like that is caused by an excess pull of a user.

Furthermore, it is possible for a user to feel a click feeling that is produced at a time when the plunger 413 moves beyond the first protrusion part 421 or the second protrusion part 422. Thereby, it is possible for a user to readily recognize that the plunger 413 moves beyond the first engaging point 421*b* or the second engaging point 422*b* by a pull operation of the second operation part 30.

Furthermore, the first engaging point 421*b* and the second engaging point 422*b* are arranged at substantially identical heights, so that it is possible for a user to execute an operation that maintains a valve-opened state of the manual operation valve 411 (a valve opening operation) and an operation that releases the valve-opened state of the manual operation valve 411 (a valve closing operation) with identical operational feelings.

Furthermore, it is possible to switch between a valve-opened state and a valve-closed state of a manual operation valve by rotating the rotor 418 without rotating the plunger 413, so that it is possible to prevent or reduce generating of a twist of the second wire 31 and/or the pushing member 415 and it is possible to prevent or reduce breakage of the second wire 31 and/or the pushing member 415 and/or a change in usability thereof.

Furthermore, in the flush toilet 10 according to a second embodiment, a user does not have to continue to operate the second operation part 30 (continue to pull the manual operation valve 411) in the water supply mechanism 400, so that it is possible for a user to execute water supply by a simple operation. Thereby, it is possible to reduce a load of toilet washing on a user at a time of power failure.

Figure 15:
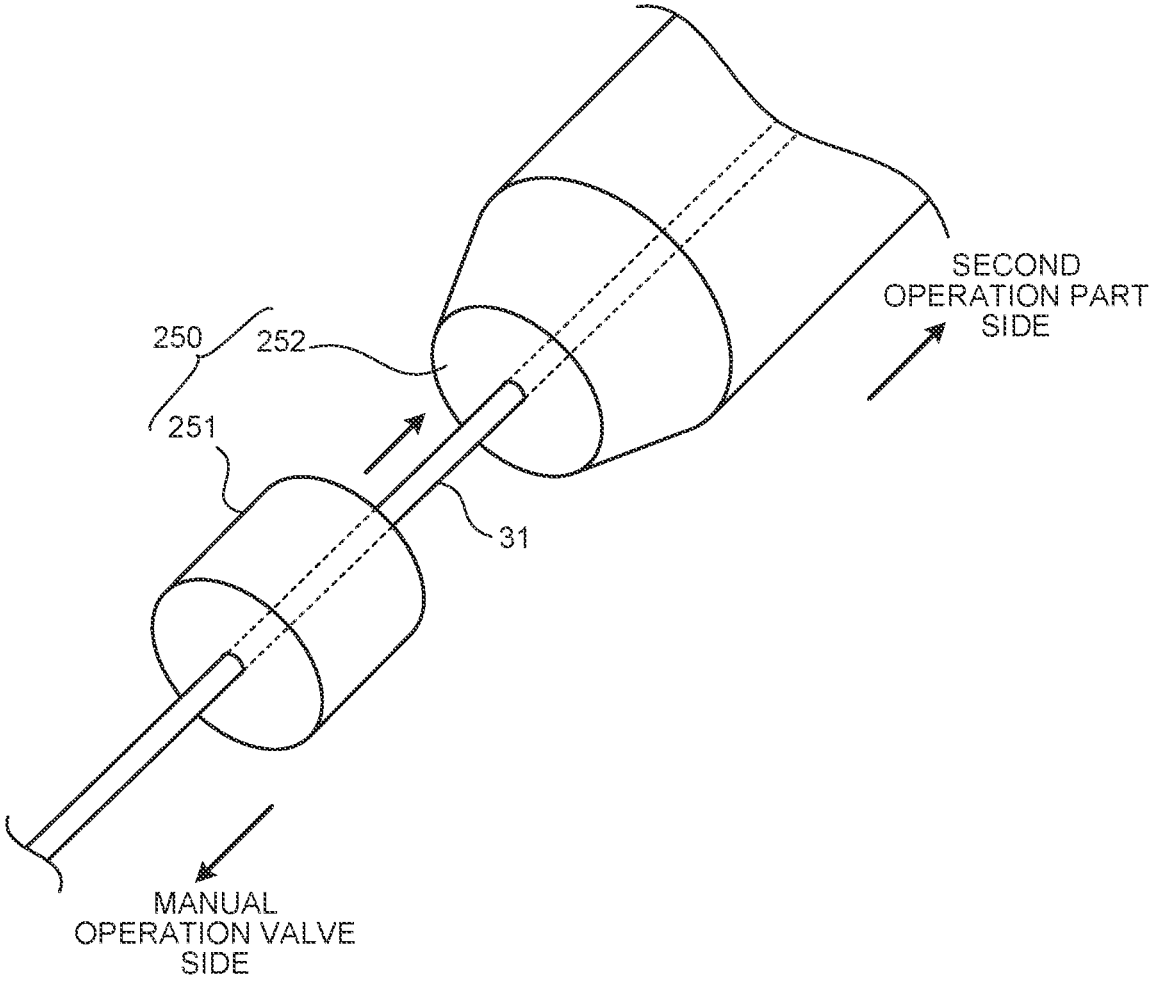
FIG. 15 is a schematic perspective view that illustrates a pull restriction part.

Additionally, in a first embodiment and a second embodiment as described above, the transmission part (second wire) 31 may have a pull restriction part 250 as illustrated in FIG. 15. The pull restriction part 250 restricts a pull stroke of the manual operation part 30. The pull restriction part 250 is provided on a side of the manual operation part 30 (see FIG. 3) relative to the manual operation valve 181, 411. The pull restriction part 250 includes a following part 251 and a restriction part 252.

As described above, the second wire 31 includes an outer tube and an inner wire that is inserted into and provided in the outer tube. The following part 251 is a member with a block shape and is provided in an inner wire. The restriction part 252 is an end part (an end surface part) of an outer tube on a side of the manual operation valve 181, 411. As the second operation part 30 is pulled and operated and the second wire 31 is pulled, the following part 251 impinges on the restriction part 252 and a pull stroke of the second operation part 30 is restricted. In such a case, an attachment position of the following part 251 is adjusted in such a manner that the following part 251 impinges on the restriction part 252 before the plunger 183, 413 that is connected to the second wire 31 impinges on the cover member 187, 417 or the like.

In such a configuration, it is possible to prevent or reduce an excess pull operation of the second operation part 30 by the pull restriction part 250, so that it is possible to improve safety. Furthermore, although the water supply mechanism 199, 400 is generally stored inside the toilet washing device 150 so that repair is complicated as breakage is caused by an excess pull operation of the second operation part 30, the pull restriction part 250 is provided outside the manual operation valve 181, 411 so that repair or the like is readily executed. That is, it is possible to improve a maintenance property. Furthermore, the pull restriction part 250 is provided outside the manual operation valve 181, 411, so that, even if a user executes an excess pull operation, the manual operation part 30 is broken before the manual operation valve 181, 411 is broken, and hence, it is possible to prevent or reduce generation of a defect in water shut-off that is caused by breakage of the manual operation valve 181, 411.

Furthermore, by returning to FIG. 13, in a first embodiment and a second embodiment as described above, the cover member 417 may have, on an upper part thereof, a convex space 417*b* that is a space that is larger than a range of a pull stroke of the second operation part 30 in the pull restriction part 250 as illustrated in FIG. 13.

In such a configuration, it is possible to further reduce a risk of breaking the water supply mechanism 199, 400 by an excess pull operation of the second operation part 30.

An aspect of an embodiment aims to provide a water supply mechanism and a flush toilet that are capable of reducing a load of toilet washing on a user at a time of power failure.

A water supply mechanism according to an aspect of an embodiment includes an electromagnetic valve and a switching part that each execute switching between water supply and water shut-off for a bowl part, a manual operation valve that is provided on the switching part and is capable of a manual operation thereof through a manual operation part, a transmission part that joins the manual operation valve and the manual operation part and transmits an operation of the manual operation part to the manual operation valve, and a pushing member that pushes the manual operation valve to provide a valve-closed state thereof, wherein the manual operation valve is pulled in a direction opposite to a pushing direction of the pushing member to provide a valve-opened state thereof, the manual operation valve has a plunger, an external cylinder member with a cylindrical shape that encloses the plunger, a first engaging point that is enclosed in the external cylinder member, and a fixation part that is enclosed in the external cylinder member and fixes the plunger in the valve-closed state or the valve-opened state, the plunger is joined to the transmission part, moves beyond the first engaging point relative to the external cylinder member as the manual operation valve is pulled by the manual operation part, and is fixed in the valve-opened state by the fixation part in a middle of returning thereof that is caused by being pushed by the pushing member as a pull of the pulled manual operation valve is released.

According to such a configuration, it is possible to maintain a valve-opened state of a manual operation valve that is pulled so as to provide the valve-opened state even when a pull thereof is released. Hence, a user does not have to continue to operate a manual operation part (continue to pull a manual operation valve), so that it is possible for the user to execute water supply by a simple operation. Thereby, it is possible to reduce a load of toilet washing on a user at a time of power failure. Furthermore, a structure is provided where a pull of a manual operation valve is released so that it is possible to maintain a valve-opened state without depending on an operational force and/or an operation method of a user, so that it is possible to prevent or reduce breakage of a manual operation part, a transmission part, and/or the like. Moreover, a manual operation valve is provided in a valve-opened state by a pull operation of a manual operation part, so that it is possible for a user to confirm that water supply is started and subsequently end the pull operation so as to maintain the valve-opened state. Hence, it is possible to prevent an operation mistake such as ending water supply before a manual operation valve is provided in a valve-opened state by an insufficient pull or the like.

Furthermore, in the water supply mechanism as described above, the manual operation valve has a second engaging point that is enclosed in the external cylinder member and is arranged side by side with the first engaging point, and the plunger moves beyond the second engaging point relative to the external cylinder member as the manual operation valve is pulled by the manual operation part from a state where it is fixed in the valve-opened state, and fixation thereof by the fixation part is released as a pull of the pulled manual operation valve is released.

According to such a configuration, it is possible to provide a valve-closed state of a manual operation valve according to an operation method that is identical to an operation method that provides a valve-opened state thereof. Hence, complication of an operation is prevented or reduced, so that it is possible for a user to execute water shut-off by a simple operation. Thereby, it is possible to further reduce a load of toilet washing on a user at a time of power failure. Furthermore, a structure is provided where a pull of a manual operation valve is released so that maintenance of a valve-opened state is ended without depending on an operational force and/or an operation method of a user (a structure that provides a valve-closed state), so that it is possible to prevent or reduce breakage of a manual operation part, a transmission part, and/or the like.

Furthermore, the water supply mechanism as described above further includes a guide rib that is enclosed in the external cylindrical member and guides the plunger, wherein the guide rib has a first protrusion part and a second protrusion part on an upper part thereof, the first protrusion part has a first sloping surface that is sloped in a predetermined direction where an upper end part of the first sloping surface forms the first engaging point, and the second protrusion part has a second sloping surface that is sloped in a direction that is identical to that of the first sloping surface where an upper end part of the second sloping surface forms the second engaging point.

According to such a configuration, it is possible for a user to feel a click feeling that is produced at a time when a plunger moves beyond a first protrusion part or a second protrusion part. Thereby, it is possible for a user to readily recognize that a plunger moves beyond a first engaging point or a second engaging point by a pull operation of a manual operation part.

Furthermore, in the water supply mechanism as described above, the first engaging point and the second engaging point are arranged at substantially identical heights.

According to such a configuration, a first engaging point and a second engaging point are arranged at substantially identical heights, so that it is possible for a user to execute an operation that maintains a valve-opened state of a manual operation valve (a valve opening operation) and an operation that releases a valve-opened state of the manual operation valve (a valve closing operation) with identical operational feelings.

Furthermore, the water supply mechanism as described above further includes a rotor that is attached to the plunger and is rotatable relative to the plunger, wherein the plunger has a plurality of mountain-shaped ribs that are provided on an outer peripheral surface thereof where a sloping surface is formed on an upper part thereof, and are formed at a height that is substantially identical to that/those of a recessed part(s) between a plurality of the guide ribs, and the rotor has a cam part that is arranged above the mountain-shaped ribs where a sloping surface that is sloped at a sloping angle that is substantially identical to those of the sloping surfaces of the mountain-shaped ribs is formed thereon.

According to such a configuration, it is possible to switch between a valve-opened state and a valve-closed state of a manual operation valve by rotating a rotor without rotating a plunger, so that it is possible to prevent or reduce generating of a twist on a transmission part and/or a pushing member and it is possible to prevent or reduce breakage of the transmission part and/or the pushing member and/or a change in usability.

Furthermore, in the water supply mechanism as described above, the transmission part has a pull restriction part that is provided on a side of the manual operation part relative to the manual operation valve and restricts a pull stroke of the manual operation part.

According to such a configuration, it is possible to prevent or reduce an excess pull operation of a manual operation part by a pull restriction part, so that it is possible to improve safety. Furthermore, although a water supply mechanism is generally housed inside a washing device so that repair is complicated as breakage is caused by an excess pull operation of a manual operation part, a pull restriction part is provided outside a manual operation valve so that repair or the like is readily executed. That is, it is possible to improve a maintenance property. Furthermore, a pull restriction part is provided outside a manual operation valve, so that a manual operation part is broken before the manual operation valve is broken even if a user executes an excess pull operation, and hence, it is possible to prevent or reduce generation of a defect of water shut-off that is caused by breakage of the manual operation valve.

Furthermore, in the water supply mechanism as described above, the external cylinder member has a cover member that closes an upper part opening thereof, and the cover member has, on a central part thereof, an opening part where the transmission part is inserted therethrough, and has a convex space on an upper part thereof so as to provide a space that is larger than a pull stroke range of the manual operation part in the pull restriction part.

According to such a configuration, it is possible to further reduce a risk of breaking of a water supply mechanism that is caused by an excess pull operation of a manual operation part.

A flush toilet according to an aspect of an embodiment includes the water supply mechanism as described above, and a toilet body that has the bowl part where washing water is supplied thereto by the water supply mechanism.

According to such a configuration, a user does not have to continue to operate a manual operation part (continue to pull a manual operation valve) in a water supply mechanism, so that it is possible for a user to execute water supply by a simple operation. Thereby, it is possible to reduce a load of toilet washing on a user at a time of power failure.

Furthermore, in the flush toilet as described above, a rim water spout is caused by a direct pressure of a water supply, and water drainage is executed by opening/closing of a water drainage socket.

According to such a configuration, a user does not have to continue to operate a manual operation part (continue to pull a manual operation valve) in a water supply mechanism, so that it is possible for a user to execute water supply by a simple operation. Thereby, it is possible to reduce a load of toilet washing on a user at a time of power failure.

According to an aspect of an embodiment, it is possible to reduce a load of toilet washing on a user at a time of power failure.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A water supply mechanism, comprising:

an electromagnetic valve and a switching part that each execute switching between water supply and water shut-off for a bowl part;

a manual operation valve that is provided on the switching part and is capable of a manual operation thereof through a manual operation part;

a transmission part that joins the manual operation valve and the manual operation part and transmits an operation of the manual operation part to the manual operation valve; and a pushing member that pushes the manual operation valve to provide a valve-closed state thereof, wherein the manual operation valve is pulled in a direction opposite to a pushing direction of the pushing member to provide a valve-opened state thereof, the manual operation valve includes a plunger, an external cylinder member with a cylindrical shape that encloses the plunger, a first engaging point that is enclosed in the external cylinder member, and a fixation part that is enclosed in the external cylinder member and fixes the plunger in the valve-closed state or the valve-opened state, the plunger is joined to the transmission part, moves beyond the first engaging point relative to the external cylinder member as the manual operation valve is pulled by the manual operation part, and is fixed in the valve-opened state by the fixation part in a middle or returning thereof that is caused by being pushed by the pushing member as a pull of the pulled manual operation valve is released.

2. The water supply mechanism according to claim 1, wherein the manual operation valve includes a second engaging point that is enclosed in the external cylinder member and is arranged side by side with the first engaging point, and the plunger moves beyond the second engaging point relative to the external cylinder member as the manual operation valve is pulled by the manual operation part from a state where it is fixed in the valve-opened state, and fixation thereof by the fixation part is released as a pull of the pulled manual operation valve is released.

3. The water supply mechanism according to claim 2, further comprising a guide rib that is enclosed in the external cylindrical member and guides the plunger, wherein the guide rib includes a first protrusion part and a second protrusion part on an upper part thereof, the first protrusion part includes a first sloping surface that is sloped in a predetermined direction where an upper end part of the first sloping surface forms the first engaging point, and the second protrusion part includes a second sloping surface that is sloped in a direction that is identical to that of the first sloping surface where an upper end part of the second sloping surface forms the second engaging point.

4. The water supply mechanism according to claim 3, wherein the first engaging point and the second engaging point are arranged at substantially identical heights.

5. The water supply mechanism according to claim 4, further comprising a rotor that is attached to the plunger and is rotatable relative to the plunger, wherein the plunger includes a plurality of mountain-shaped ribs that are provided on an outer peripheral surface thereof where a sloping surface is formed on an upper part thereof, and are formed at a height that is substantially identical to that/those of a recessed part(s) between a plurality of the guide ribs, and the rotor includes a cam part that is arranged above the mountain-shaped ribs where a sloping surface that is sloped at a sloping angle that is substantially identical to those of the sloping surfaces of the mountain-shaped ribs is formed thereon.

6. The water supply mechanism according to claim 1, wherein the transmission part includes a pull restriction part that is provided on a side of the manual operation part relative to the manual operation valve and restricts a pull stroke of the manual operation part.

7. The water supply mechanism according to claim 6, wherein the external cylinder member includes a cover member that closes an upper part opening thereof, and the cover member includes, on a central part thereof, an opening part where the transmission part is inserted therethrough, and includes a convex space on an upper part thereof so as to provide a space that is larger than a pull stroke range of the manual operation part in the pull restriction part.

8. A flush toilet, comprising:

the water supply mechanism according to claim 1; and a toilet body that includes the bowl part where washing water is supplied thereto by the water supply mechanism.

9. The flush toilet according to claim 8, wherein a rim water spout is caused by a direct pressure of a water supply, and water drainage is executed by opening/closing of a water drainage socket.

* * * * *